US006321657B1

(12) United States Patent
Owen

(10) Patent No.: US 6,321,657 B1
(45) Date of Patent: Nov. 27, 2001

(54) RAIL TRANSIT SYSTEM

(76) Inventor: William E. Owen, 481 S. Keeler Woods Dr., Marietta, GA (US) 30064

( * ) Notice: Subject to any disclaimer, the term of this patent is extended or adjusted under 35 U.S.C. 154(b) by 0 days.

(21) Appl. No.: 09/260,144

(22) Filed: Mar. 1, 1999

Related U.S. Application Data

(60) Provisional application No. 60/076,593, filed on Mar. 3, 1998.

(51) Int. Cl.[7] ..... B61B 13/04

(52) U.S. Cl. ..... 104/119; 104/28; 104/124; 188/38; 188/41; 238/382; 246/122 R

(58) Field of Search ..... 104/118, 119, 104/120, 121, 124, 28; 246/108, 109, 110, 123, 34 R; 52/174, 381, 382, 125.1, 126.5; 188/38, 41, 62

(56) References Cited

U.S. PATENT DOCUMENTS

| | | | | |
|---|---|---|---|---|
| 3,122,105 | | 2/1964 | Scherer . | |
| 3,225,703 | | 12/1965 | Lemcke | 104/120 |
| 3,399,629 | | 9/1968 | Hawes | 104/118 |
| 3,503,471 | | 3/1970 | Balke . | |
| 3,677,188 | * | 7/1972 | Bordes | 104/120 |
| 3,865,040 | * | 2/1975 | Steen | 104/118 |
| 3,868,908 | * | 3/1975 | Pelabon | 105/1 R |
| 3,871,303 | | 3/1975 | Woodling . | |
| 3,890,904 | * | 6/1975 | Edwards | 104/121 |
| 3,919,947 | * | 11/1975 | Simon et al. | 104/124 |
| 3,956,994 | * | 5/1976 | Barry | 104/88 |
| 4,000,702 | | 1/1977 | Mackintosh . | |
| 4,195,576 | * | 4/1980 | Gutridge | 104/121 |
| 4,313,383 | * | 2/1982 | Parazader | 104/124 |
| 4,503,778 | * | 3/1985 | Wilson | 104/28 |
| 4,690,064 | | 9/1987 | Owen | 104/119 |
| 4,727,814 | * | 3/1988 | Nielsen | 105/1.1 |
| 5,006,847 | * | 4/1991 | Rush et al. | 246/122 R |
| 5,176,082 | * | 1/1993 | Chun et al. | 104/28 |
| 5,364,047 | * | 11/1994 | Petit et al. | 246/122 R |
| 5,372,072 | * | 12/1994 | Hamy | 104/119 |
| 5,456,183 | | 10/1995 | Geldbaugh | 104/121 |
| 5,651,318 | * | 7/1997 | O'Donohue | 104/124 |
| 5,797,330 | * | 8/1998 | Li | 104/28 |
| 5,927,444 | * | 7/1999 | Checketts | 188/41 |
| 5,934,198 | * | 8/1999 | Fraser | 104/119 |
| 5,992,575 | * | 11/1999 | Kim | 188/38 |
| 6,027,033 | * | 2/2000 | Vanhonacker | 238/382 |

FOREIGN PATENT DOCUMENTS

| | | |
|---|---|---|
| 1 935 769 | 9/1970 | (DE) . |
| 1 558 539 | 1/1969 | (FR) . |
| 2 266 621 | 10/1975 | (FR) . |
| WO 93 01961 | 2/1993 | (WO) . |

* cited by examiner

*Primary Examiner*—S. Joseph Morano
*Assistant Examiner*—Lars A. Olson
(74) *Attorney, Agent, or Firm*—Pillsbury Winthrop LLP

(57) ABSTRACT

A monorail transit system includes transit drive units for supporting a transit car body on a beam and propelling the body along the beam. Improvements to the transit system include a quiet steel rail with vibration isolation for the beam, a vehicle braking system using a fixed plat engaged with a steel rail to arrest motion of the drive unit, a beam stabilizing support structure comprising a column with an insert that extends into a hollow beam portion, a drive unit coupled to the transit car body so as to be able to rotate with respect to the body while the drive unit and transit car body are traversing a curve in the rail, a leveling system for automatically leveling the car body with respect to a loading platform and a mechanism for automatically tilting the car body in response to centrifugal forces and then leveling the body, an articulating car body for accommodating curved beams, and a mechanism for providing positive traction on an inclined steel rail.

14 Claims, 24 Drawing Sheets

RAIL TRANSIT SYSTEM

This application claims the benefit of U.S. Provisional Application No. 60/076,593, filed Mar. 3, 1998.

FIELD OF THE INVENTION

The present invention relates to improvements in a monorail transportation system that improve the utility, comfort, safety, and cost-effectiveness of the system.

BACKGROUND AND SUMMARY OF THE INVENTION

In recent years, interest in providing rail-type mass transit in urban and suburban areas, between adjacent pairs of cities, between cities and satellite service facilities such as outlying airports, sports stadia and the like has increased.

Often the feasibility of providing or extending such a transit system fundamentally hinges on cost.

Although some cities, such as San Francisco, Calif., Washington, D.C. and Baltimore, Md. were successful in initiating construction of their rail urban mass transit systems at a time when a combination of cost factors worked in their favor, those same conjunctions of favorable factors do not presently exist: federal government funding assistance is not so forthcoming, energy prices are at least temporarily in decline, right of way land acquisition costs and construction costs have risen, and car fabrication plants have closed down domestic production lines.

Yet the need of many for convenient rail-type mass transit goes unmet. It is clear that if more of such mass transit systems are to be built, some innovations are needed.

In U.S. Pat. No. 4,690,064 (the disclosure of which is hereby incorporated by reference), monorail beam is provided with a lower, upwardly-facing support surface, a lower, laterally-facing support surface and an upper, medially-facing support surface (relative to the support beam). Vehicles are hangingly supported, pendulum-like, from davit-like cantilevering arms of support drive units having wheels which run on or act against the beam support surfaces so that they run along the side or sides of the beam. The beam may be elevated on columns, surface mounted, or depressed in tunnels. By preference, the vehicles' bodies are detachable from the drive units, and the heaviest air-conditioning components are mounted on the drive units rather than on the bodies. Power transmission and automatic control systems are described, as are switching systems and station facilities.

While the transit system described in the '064 patent constitutes a viable rail system for many urban and suburban regions, it and other transit systems can be improved in many areas, including utility, safety, comfort, and cost-effectiveness in installation and maintenance.

For example, transit vehicles normally are rubber-tired where possible to prevent excessive noise from being propagated to the surrounding environment and causing noise pollution. A drawback to this method is that rubber tires have speed limits (60 to 70 miles per hour) due to construction limits of the tire material, and rubber tires are subject to catastrophic failure when overheated or when overloaded. Additionally, rubber tires normally wear out rapidly in transit service and must be inspected and replaced at regular intervals. Steel wheels on steel rail are preferred for low operating cost, longevity, and safety, but noise damage to the environment makes use of such materials undesirable.

According to one aspect of this invention, an improved construction and method are presented for using steel wheels on steel rails which provide quiet operation and low operating cost, longevity, and safety.

Passenger vehicles operating between cities or which must accommodate passengers for long distance travel presently use railway-type cars which have limited space for carry-on baggage and no provision for wheelchair-borne passengers, refreshments, and toileting facilities.

According to another aspect of this invention, a dual-sided monorail vehicle plan accommodates all requirements for intercity travel for improved comfort for passengers.

Freight is presently moved between origin and destination points by drive unit, rail, barge, and aircraft. In locations where roadways are crowded and air pollution problems may cause drive unit operation to be restricted or prohibited, an alternative means of moving freight is needed. Rail freight methods are an acceptable alternative, but the marshaling of rail cars for movement of trains makes the time consumed undesirable, and a better method is needed. Also, in freight movement by air there is a need for the very rapid transshipment of freight from aircraft arriving at one airport to be moved to a second airport so that departing aircraft may continue with the movement of the freight by air.

According to another aspect of this invention, a vehicle provides a means for moving such freight rapidly between points in less than trainload quantities (i.e., in single container quantities) without causing airborne pollution and at a speed much higher than that offered by the alternative modes of transportation. It also allows single units of freight to be moved by fully automated means, reducing labor costs and shipping time. A new lightweight freight container used in the system has the ability to be transferred easily between the available freight modes.

In conventional braking systems the ability to stop a vehicle is limited to the amount of heat energy which can be stored in conventional brake drums, brake discs, steel wheels, or other brake system heat-sinks which move with the vehicle, and which may be overloaded from the absorption of kinetic energy caused by frequent vehicle stops.

According to another aspect of this invention, a braking system, which would be used primarily in rapid transit systems and railway systems has a fixed guideway with a brake plate or combination rail and brake plate, such that the heat sink is the rail plate or brake plate which absorbs the kinetic energy while continuously presenting a new heat sink for use by the moving brake pads. Additionally, the cooler rail plate or brake plate will cool the moving brake pads preventing overheating of the brake pads, extending brake pad longevity. The system can be used on vehicles with rubber tires or with steel wheels on rails or with magnetic levitation systems. The system can be controlled to be partially-acting or fully acting according to design and operation choices.

Transit systems require unloading of passengers and loading of passengers for each vehicle as a vehicle presents itself in a station. In stations where the vehicles are presented at brief intervals, but unloading and loading of passengers requires a period longer than the station dwell time (the period of time the vehicle is stopped for unloading and loading operations) allowed by the vehicle intervals (headway), a means is desirable for allowing both short vehicle headways and long station dwell time.

According to another aspect of this invention, a passenger loading/unloading system allows both short vehicle headways and long station dwell time.

Transit vehicles remain in transit passenger stations sufficiently long to discharge arriving passengers and board departing passengers, the time period being called dwell time. In transit systems with short headway times (separation of consecutive vehicles along a transit vehicle path) dwell times may be greater than the headway time, creating a limitation of the briefness of headways, thereby limiting the efficiency of the transit system.

According to another aspect of this invention, a procedure described herein extends the effective dwell time of a vehicle without negatively affecting the headway time of the system.

Structural beams on top of columns supporting such beams may move with respect to the columns from forces caused by thermal expansion and contraction, as well as from local vibration forces and from earthquakes and earth tremors. It is desirable that beams on top of columns remain where placed by design.

According to another aspect of this invention, a beam stabilizer prevents lateral movement of beams on columns, while allowing motion of beams linearly as may be caused by thermal expansion and contraction.

Concrete support columns for fixed guideway transit systems, bridges, roadways, and buildings frequently employ site-erected methods for construction. This present system is expensive, and places construction workers at grave risk when construction work is alongside in-use roadways or in buildings under construction.

According to another aspect of this invention, a construction and method presented herein will reduce danger to workers, reduce costs of construction, and speed up the construction of fixed guideway transit systems, bridges, roadways, and buildings, while allowing increased control of quality of the finished product.

A beam to be used for supporting fixed guideways, roadways, bridges, or buildings may have more uses than as only a structural beam. By design, a beam may have a hollow core to allow for greater structural strength for resistance to bending in any plane or in torsion. In a fixed guideway there is a need for a place to insert a top-of-column extension insert to restrain the end or other portion of a beam from lateral movement, a need for a location for protected electrical power, control, and communications wiring or light guides, and a need for assisting extension of gas, water and liquid fuels in pipelines which are not underground.

According to another aspect of this invention, a construction is presented which maximizes the utility of the beam supporting the fixed guideways by providing spaces for power and optic lines and piping or other forms of conduit.

In transit systems there is a requirement for coupling of normally independent automated (driverless) or non-automated (with driver) transit vehicles for use as a single train of two or more transit vehicles and for coupling of drive units of a single vehicle. Present methods of coupling are with mechanical couplers between drive or idler drive units of the coupled vehicles.

According to another aspect of this invention, mechanical and control coupling of multiple transit vehicles or drive units is provided by physical interconnection of drive units mounted on a guideway, but without physical interconnection of passenger cabins or freight containers. Further, the linkage between two drive units serving one cabin or container provides a linkage for combining the motive thrust or braking of both interconnected drive units.

Dual-sided monorail systems have a special geometry relationship between the guideway-mounted drive units and the vehicle. In a dual-sided monorail system having separate but linkage bar interconnected drive units on a guideway and a bottom supported or top suspended cabin for passengers or a freight container, the support or suspension arms must be rigidly attached to the vehicle or the drive units with motion of a rotating support arm pivoting only at one end. As a preference, rigid attachment of the support arms to the drive units with a rotation axis of the support arms at the drive units ends necessitates providing a means for movement of the same arms with respect to the cabin or container.

According to another aspect of this invention, an apparatus establishes a means for allowing motion of the support arms for a transit vehicle on a curved fixed guideway while also providing for vertical support of the cabin or container. It simultaneously provides thrusting and retarding forces applied from the drive units end of the support arms to the cabin or container.

Vehicles on guideways with tracks on fixed beds normally maintain the beds level with the passenger unloading/loading station platform so that the vehicle cabin floor is level with the platform. In a vehicle with spring, hydraulic or air bag suspension, variable and asymmetrical passenger loading can cause a vehicle to be at a station platform in a non-level position, both laterally and longitudinally. There is a need for a means for leveling such a vehicle while in a station so that unloading and loading of the vehicle can be accomplished with the vehicle floor in the same plane (level) as the station platform.

According to another aspect of this invention, a cabin leveling system provides for a low-cost reliable means for such leveling.

In a vehicle with hydraulic, air bag or spring suspension, asymmetrical and variable passenger loading can cause a vehicle to be on a guideway in a non-level position, both laterally and longitudinally.

According to another aspect of this invention, a system is provided for positioning a vehicle cabin floor such that passengers feel centrifugal and gravity forces perpendicular with respect to the cabin floor while in motion along the vehicle pathway by causing the system to tilt the vehicle to predetermined angles while in curved pathways on a guideway, thereby accommodating the comfort of passengers within the cabin by allowing the cabin to modify centrifugal forces acting on the passengers to be perceived as perpendicular to the floor, as in a banked roadway or railway, but without banking the guideway. Such a tilting system can provide such banking curves with centrifugal forces either away from the guideway or toward the guideway, depending on the curvature of the section of guideway being encountered by the vehicle.

Transit vehicles may from time to time require auxiliary means for moving a vehicle with drive units and cabin or freight container to selected locations on a guideway for service or removal and to access the guideway for maintenance and inspection services.

According to another aspect of this invention, the auxilliary means is a vehicle positioned either behind the vehicle requiring moving, or in front of the vehicle requiring moving. The vehicle may include a towing or pushing bar connecting drive units, as is provided for in interconnecting drive units and trains of vehicles. Additionally, top-of-guideway vehicles may be required to perform as fire-protection vehicles, emergency medical services vehicles, maintenance support, or passenger evacuation vehicles, where ordinary ground-based services are not convenient. A vehicle is described herein for using the flat roadway-type surface of the top of a guideway where the guideway is sufficiently wide to accommodate such vehicles.

Heavy and long beams which must be transported on highways are difficult to move due to the geometry of the transporting vehicles not easily matching the beams being moved. The present method is to use a single rigid trailer with the beam supported by the trailer and a set of wheels for the portion of the beam overhanging the end of the trailer, imposing a very heavy load on the trailer and roadway, sometimes causing damage. Further, the size and weight of the beams to be transported is limited by the means for transport and the limitations of wheel loading on roadways.

According to another aspect of this invention, a mechanism is provided for transporting long beams which overcomes these disadvantages In automated and operator-assisted transit systems there is a need for a means of transmitting control information from a central supervising station to a moving vehicle and for a moving transit vehicle to determine its exact location within a geographical area. Additionally, there is a need for transmitting control data, video images, voice, location data and other information from a moving vehicle to a central supervising station. At present the methods used are primarily via proximity signals along the guideway or track and by visual signals which are read by vehicle operators. These present methods are inadequate for supervision and control of driverless vehicles and for assistance to vehicle operators.

According to another aspect of this invention, a wireless communication system allows for wireless communication between a transit vehicle and central control location and between a transit vehicle and a geostationary satellite.

Dual-sided monorail vehicles have a spatial relationship with guideway beams which require that special consideration be given to the length of a cabin such that the moving cabin will not touch the guideway when the guideway is curved. To avoid the touching of the guideway by the cabin, the cabin length can be kept short or the space between the guideway and the cabin can be increased.

According to another aspect of this invention, a cabin is divided into two or more articulating sections such that the apparent cabin length will be shortened and the problem will be minimized.

Present methods of transit system passengers continuing to their destinations after using a transit system and arriving at a transit station include pick-up by others in cars, use of personal cars parked in station parking lots, walking, buses, and taxicabs. Walking is sometimes not a solution to the passenger's needs because of weather, time consumed and long distances involved. Buses are very slow, and frequently do not go near the final destination. Taxicabs resolve these problems, but sometimes are not available and are costly and inconvenient. Dedicated personal vehicles are very expensive to purchase, insure and maintain. An alternative means is needed to provide a low cost, quick, convenient and reliable way for transit passengers to continue to final destinations and for use during the day for short trips for lunch and shopping. The use of a transit vehicle for a high percentage of a trip distance would reduce the amount of air pollution caused by the trip, extend the utilization of new and existing transit systems to reduce the amount of roadway space used by the trip.

According to another aspect of the invention, rental cars are provided as an option for use by patrons of the transit system to complete the transit trip.

Steel wheels providing traction on steel rails are limited to the coefficient of friction between the materials such that the reactive force from a drive wheel to a rail is limited. This is a problem when providing traction to a vehicle drive wheel where a steel rail is used since angles of climb are limited to the reactive force developed before slipping occurs, usually about 12% slope.

According to another aspect of this invention, a construction provides positive traction between the drive wheel and the steel rail to allow vehicles to increase angles of climb above 12% slope.

Stations for monorail systems are usually elevated and located above at-grade access of passengers. Such stations are costly and inconvenient to construct.

According to another aspect of this invention, a lower cost station arrangement allows passenger boarding of monorail vehicles at grade.

Transit and other vehicles which operate using alternating current (AC) electric motors need a lower cost means of applying motor torque and limiting revolutions per minute (rpm) of the motor output so that smooth vehicle starting and closely managed speed controlling can be accomplished.

According to another aspect of this invention, a speed and acceleration control system provided eliminates methods currently used which consist of costly and energy inefficient direct current rectifiers, alternating current wave choppers, frequency modulators, mechanical clutches, and belts and pulleys in order to provide for a lower cost, more reliable, lighter weight speed and acceleration control means which can be used for the special motive needs of transit and other vehicles. The arrangement specified allows an alternating current (AC) motor to run constantly at full rated rpm and power with output drive shaft torque and rpm modified to match the requirements of a transit vehicle.

Dual-sided monorail systems have a need for switching of vehicles from one guideway to another to allow for replacement of vehicles, maintenance, and system utilization of vehicles and guideways. Present methods for switching vehicles allow for displacement of guideways through lateral translation, vertical translation, and swinging of a beam from a fixed point. A need exists for a means to switch a dual-sided monorail system at high speed and short cycle times in order to allow high speed switching of vehicles in motion while not limiting vehicle headways on a system.

According to another aspect of the invention, a mechanism is provided for a swinging beam adaptation for a dual-sided monorail to provide effect such switching.

Other objects, features, and characteristics of the present invention, as well as the methods of operation of the invention and the function and interrelation of the elements of structure, will become more apparent upon consideration of the following description and the appended claims with reference to the accompanying drawings, all of which form a part of this disclosure, wherein like reference numerals designate corresponding parts in the various figures.

DETAILED DESCRIPTION

This invention represents improvements in transit systems, such as the one described in U.S. Pat. No. 4,690,064, and improved methods for operating such transit systems. For convenience to the reader, the system of the '064 patent is generally described herein with reference to FIGS. 21 and 22. For further details regarding that system, the reader is referred to the '064 patent itself.

Figure 21:
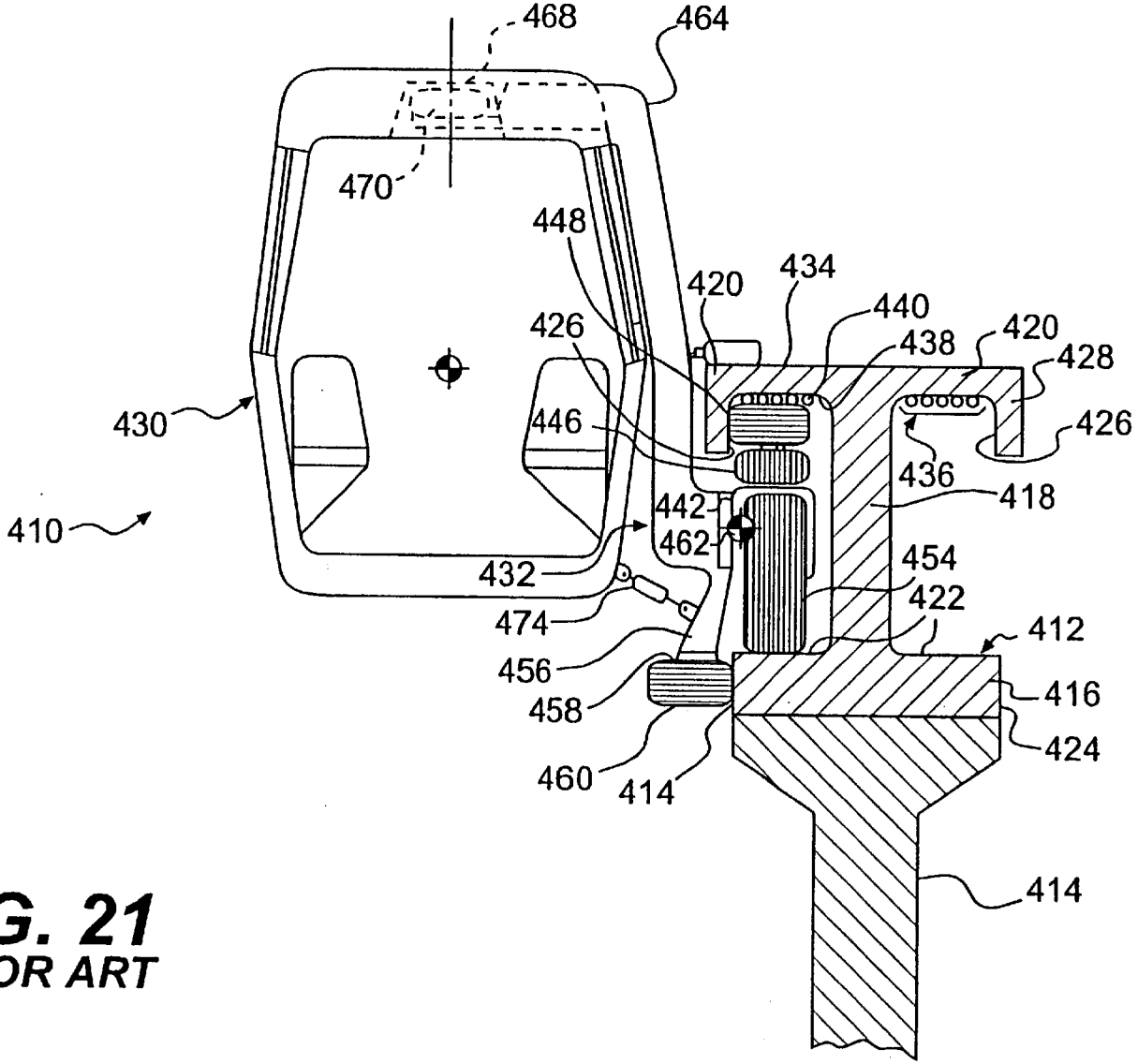
FIG. 21 PRIOR ART
FIG. 21 is a fragmentary vertical transverse cross-sectional view of a side-mounted monorail transportation system.

A key element of the side-mounted monorail support system 410 of the present invention is the system of support beams, a representative one of which is shown at 412 in vertical transverse cross-section in FIG. 21. Although the beam 412 typically would be supported on columns 414 (or pylons, towers, masts, frameworks or the like) at a level that is elevated above ground level, in order to minimize the width of right-of-way needed, and in order to minimize interference of ground-supported vehicles, people, animals and obstacles with the running of the cars, it is within the purview of the invention to mount the beams 412 in some parts of the system on suitable foundations at ground level, or on a track bed below ground level e.g. in a tunnel, tube or cut whether or not covered over by earth or other material.

As a problem in semantics, although the preferred term for the element 412 is a support beam, it would not be wrong to call it a rail or a track, or a section of or a length of a beam, rail or track. The support beam 412 is of indeterminate length. In practice, some sections or lengths of it may be but a few feet long, others may be miles long, or, conceivably, a system could be provided in which the support beam 412 is a seamless, integrally formed unit. Whether the fixed path-providing means is sectional or integral and, if sectional, what length(s) the sections have is of little importance to the broad principles of the present invention. Typically, the support beams 412 and columns 414 are made of steel rebar-reinforced concrete such as is conventionally used in the manufacture of monorail track systems, electrical utility power distribution line support pylons and the like.

For convenience in description, the path of indeterminate length provided by one or more sections of beam 412, suitably supported on the ground in end-to-end relation as a continuing series, will sometimes be referred to herein as a beam 412, without any implication being intended that such structure is monolithic or is constituted entirely by one section, unless such an interpretation would clearly be contrary to the particular passage of the text.

The beam 412 is shown being double-sided, in that it is constructed and adapted to provide two parallel paths, one spaced laterally to the left of and the other spaced laterally to the right of the imaginary vertical plane containing its longitudinal centerline, a plane about which the left and right halves of the beam are symmetrical, in the preferred embodiment. Whereas more details are given for one side, it should be assumed that, by preference, the other side is the same. In a less-preferred, but possible construction, the other side may be different, or it may be omitted.

In the preferred embodiment illustrated, the beam 412, in transverse cross-sectional figure has a T-shape, complete with serifs on its standard and arms. That is, the beam 412 is shown including a generally horizontal base plate, foot or flange 416, a generally vertical standard or web 418 medially footed on the base plate 416, and a cap or head plate, flange or cross-arm member 420.

With respect to the path provided by the left half of the support beam 412 shown in FIG. 21, there are three notably important support surfaces, namely the lower, upwardly-facing support surface 422 provided on the upper side of the base plate 416, a lower, laterally-facing support surface 424 provided on an outer end of the base plate 416, and an upper, medially-facing support surface 426 provided on a depending serif 428 provided at the lateral extreme of the head plate 420.

The base plate 416 may stand on and/or be securely mounted to any underlying structure on which it is supported from the ground e.g. via a foundation. Typically, the base plate 416 and head plate 420 are equal in width, and the head plate 420 typically is wide enough to provide an emergency escape route for persons to walk on after they have left a disabled transit car through an opened emergency hatch e.g. a car window or roof hatch.

Another fundamental unit of the system 410 is a transit car 430. In the preferred embodiment, the transit car 430 is a passenger car, although it would be within the contemplation of the invention for passengers to be accompanied by their belongings, by luggage, and the same or other cars to be outfitted for transporting freight, livestock, mail, produce and virtually every being, thing or substance heretofore, now or hereafter transported by railroad train, airplane, ship or other mass transit vehicle. A transit car 430 outfitted for carrying mainly passengers is shown by way of exemplification.

By preference, each transit car 30 is mounted to the support beam 412 for transit therealong by at least one, preferably two, and permissibly more than two drive unit 432. (If only one drive unit is provided for a relatively small car, some additional guide means are needed for serving the function of maintaining the car running parallel to the beam 412 that is provided by the second drive unit when two drive units spaced longitudinally from one another support a car 430 from the beam 412.)

Although all of the drive units 432 are identical, and are all used for driving, in some instances the drive units may be alternately powered, or some may be motorless guides.

Although a sole transit car is shown providing a complete transportation unit, in practice one, two or more like cars, conventionally hitched together may provide a train of cars.

In instances where a car or a train is made up of two or more powered drive units 432, conventional control means may be used for coordinating the application of power and braking so that there is no tendency to excessively tension or buckle a car or train by uneven application of power or brakes.

In the preferred embodiment, the motive power for the transit cars is electrical power, in the form of d.c. electrical current supplied along the support beam 412, e.g. through one or more conductors 434 secured on the underside of the respective arm of the head plate 420, so as to be sheltered and protected by the beam shape 418/420/428 which, in effect, represents a downwardly opening groove 436, the surface 438 of which is the base thereof. (Other conductors, 440, for distribution of communications and control signals may be mounted to the beam 412, e.g. in the groove 436 alongside the electrical conductor or conductors 434.)

Each drive unit 432 is shown provided with at least one known type of electrical drive motor 442 which is served with electrical power by a suitable circuit including a pantograph 444 (see FIG. 22) with a contact pressed against the conductor or conductors 434. By preference, the output shaft means of each motor 442 incorporates a clutch/brake mechanism, e.g. a magnetic particle clutch 446 which serves a respective vertical axis drive wheel 448, suitably tired, e.g. by a known rubber-tired subway drive wheel.

Figure 22:
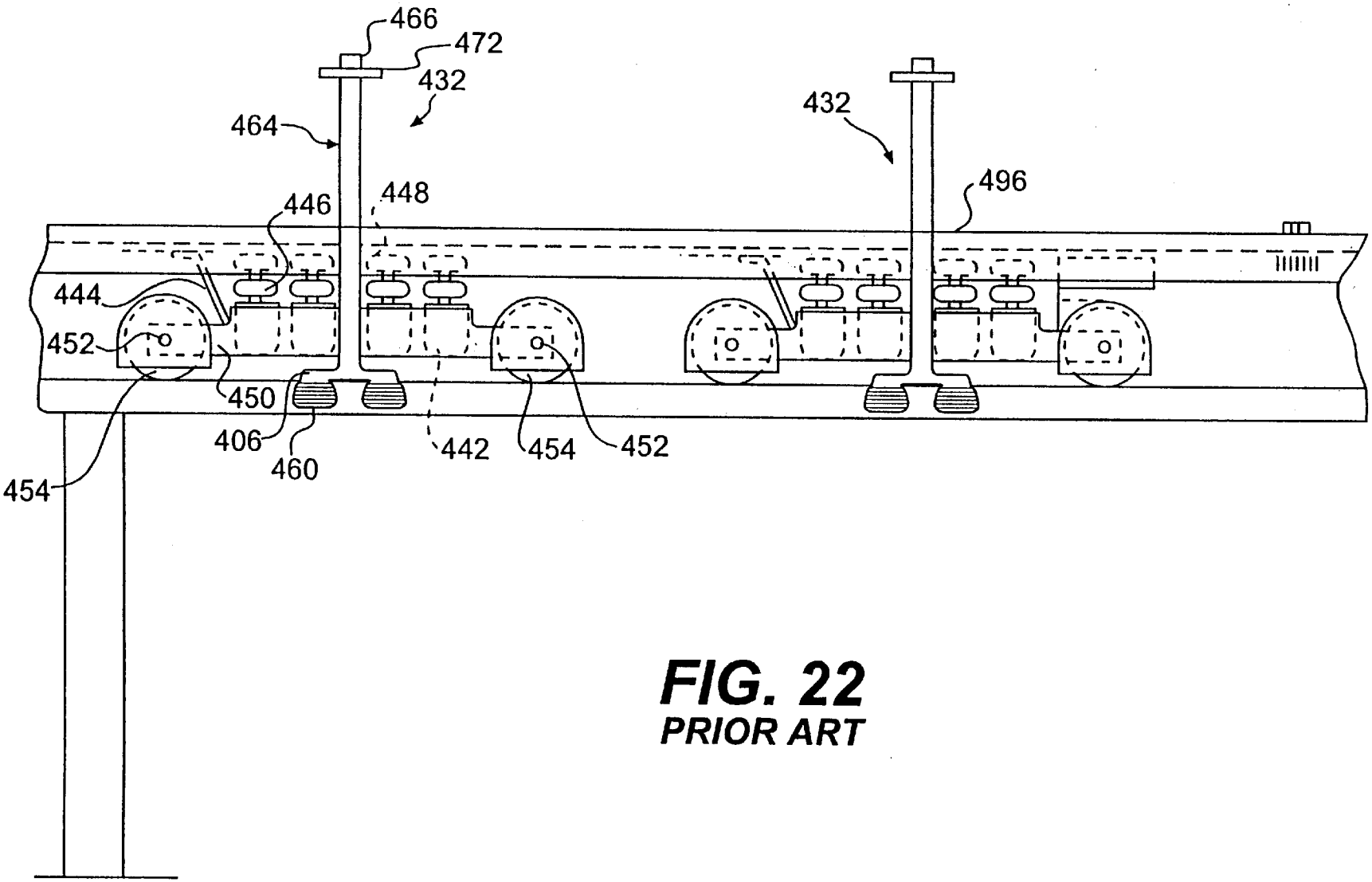
FIG. 22 PRIOR ART
FIG. 22 is a fragmentary side elevational view of the system of FIG. 21 with the vehicle body removed from the drive units.

As shown in FIG. 22, the electric motors 442 are mounted on a drive unit frame 450, e.g. as a line of four such motors, oriented output shaft upwards. The drive unit frame 450 further is shown having fore and aft horizontal axis transversally extending axles 452 mounting respective non-drive (idler) vertical support wheels 454. A centrally located downwardly bifurcated spur portion 456 of the drive unit frame 450 provides two, in-line vertical axis axles 458 mounting respective non-driven (idler) reaction wheels 460.

In the instance depicted in FIG. 21, which is preferred, the drive unit center of gravity 462 is located outboard of the vertical support wheels 454, relative to the beam 412, vertically on line with the respective edge of the base plate 416, just above the axles 452, and the axles 458 lie slightly further outboard, again relative to the beam 412.

As shown, the powered wheels 448 are in tractive engagement with the respective beam surface 426, the vertical support wheels 454 are in rolling engagement with the respective beam surface 422, and the reaction wheels 460 are in rolling engagement with the respective beam surface 424. Overlying the spur portion 456 of the drive unit frame 450, a transit car support arm 464 is footed on the frame 450 and arches or cantilevers upward and outward (relative to the beam 412) ending in a car-support fulcrum means 66.

The transit car 430 is shown being pendularly suspended by means of appropriate supports 468 from the fulcrum means of two such support arms 464.

A shock absorber 470, which may be a toroidal compressed gas-filled pillow-like or bellows-like member of a commercially available type, is shown provided about the fulcrum for reaction between opposed arm and car surfaces 472 to damp vertical bumping motion and some swinging motion. In addition, a linear shock absorber 474 for damping swinging motion is shown mounted between the body of the transit car 430 and spur portion 456 of the drive unit frame 450. Communication and control lines (not shown) may extend on or in any of the drive units and support arms to the vehicle body, or be otherwise connected between the conductors 434 and/or 440 and on-board systems and elements.

The bodies of the transit cars preferably are utterly disconnectable from the drive units 432, by simple demounting of the car bodies from the fulcrum means 466 and disconnection of suitable connectors (not shown) provided on the power/communication/control line umbilical(s).

The transit system 410 and its cars may be provided with any of the features which have come to be conventional on modern mass transit systems including the use of onboard optical scanners to read bar codes on the beam 412, on-board bar codes to be read by beam-mounted optical scanners, any of these being tied into a state-of-the-art command and control system using on-board computer equipment, off-board computer equipment (not shown) located at a central and/or regional control center, all with whatever manual control overrides for an on-board operator as are desired or thought to be necessary.

Having generally described the monorail transit system of U.S. Pat. No. 4,690,064, various structural and functional improvements to that system as well as to the method of operating that system, or other rail-based transit systems, will now be described.

1. Quiet Steel Rail With Vibration Isolation

Figure 1C:
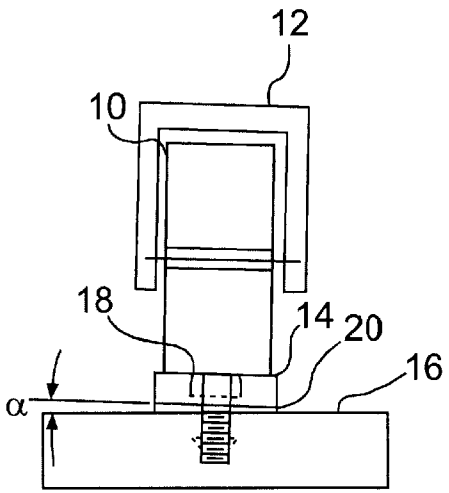
FIGS. 1*a*, 1*b*, and 1*c* are a side, top and end view of a quiet steel rail with vibration isolation according to an aspect of the present invention.
Figure 1A:
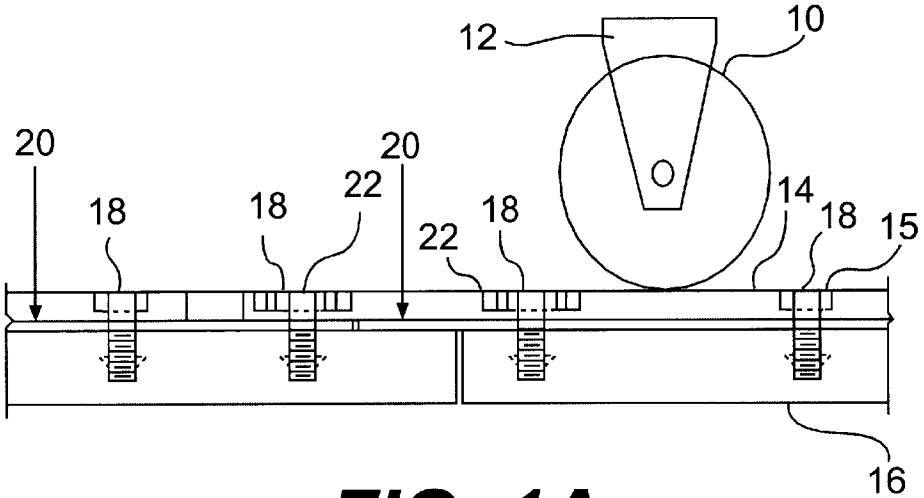
Figure 1B:
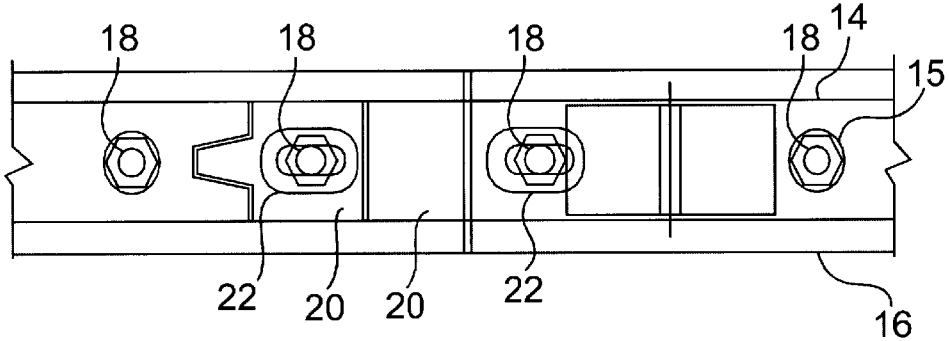

In FIG. 1*a–c* a steel wheel (10), used as an alternative to a rubber-tired wheel, carrying a rolling load caused by a vehicle (12) rolls on a steel rail (14) which is attached to a guideway (16) with anchoring devices (18) recessed into rail (14) which hold rail (14) firmly in compression on a vibration pad (20) which is between rail (14) and guideway (16). In the monorail system described above and shown in FIG. 21, the rail (14) and vibration pad (20) may be secured to surface (426), (424), and/or (422) to accommodate wheels (448), (460), and/or (454), respectively. The composition of vibration pad (20) is of such a material as to be effective in isolating vibrations of rail (14) from guideway (16). Such material may comprise fiberglass, springs, metal fibers, or plastic, but preferably comprises a neoprene rubber combination embossed pattern-solid composition which has a compression resistance sufficient to support rail (14) under load of wheel (10) while simultaneously acting to prevent vibration transmission. The embossed pattern preferably forms a waffle pattern, and, as shown in the Figure, the pad is preferably installed with the embossed pattern facing downwardly to resist the retention of rainwater and possible reduction of vibration damping and isolation.

Additionally, the material of pad (20) is sufficiently soft as to dampen the vibrations of rail (14) to prevent or minimize the vibration of rail (14) after the vibration excitation of wheel (10) has passed.

Further, the rail (14) should be of such thickness to act as a simple beam when the wheel (10) is applied to a point, thereby spreading the active load of the wheel (10) over sufficient area to not deflect the pad (20) beyond the effective thickness for vibration isolation.

Rail (14) is firmly attached to the guideway (16) by anchor bolts (18) attached with pre-tension load to guideway (16), thereby compressing pad (20) and limiting lateral motion of the rail (14) with respect to the guideway (16). Moreover, the pre-loading of the rail (14) in compression of pad (20) against the supporting structure (16) must be of such magnitude that the damping of rail (14) vibrations after excitation of a wheel has passed is effective. However, as shown in FIGS. 1*a–b*, anchor bolts (18) must be in slots (22) in the rail (14) in all but one point (15) of the rail (14) section in order to allow for thermal expansion and contraction of the rail with respect to the guideway.

For installation of the rail (14) on the guideway (16) with the pad (20) interposed, note that the rail ends are dovetailed (interlocking) to reduce clicking of wheels when rolling over rail abutting ends. Also, pad (20) is continuous across guideway ends as is rail (14), reducing rail interleaving misalignments on guideways.

A further benefit of this arrangement is shown in FIG. 1*c* where wheel (10) has a rolling contact with the rail (14) and where wheel rolling surface at contact is not perfectly in the plane of the rail, then the rail will locally compress the pad (20) to rotate rail (14) to provide for such an alignment, thereby lengthening rail and wheel life.

A further use of this system by use of standard railway rails and cross-ties with pressure plates for spreading loads on isolating pads would allow for conversion of existing railways to more quiet railways.

2. Dual-Sided Monorail Vehicle With Intercity Floor Plan

Figure 2A:
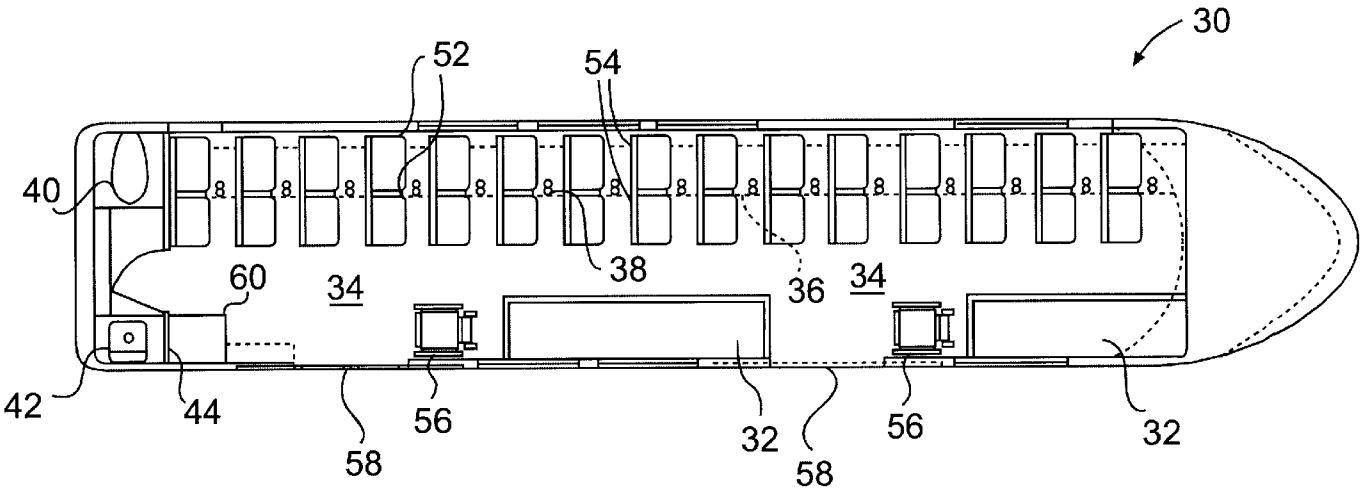
FIGS. 2*a* and 2*b* are a plan view and side elevation of an intercity monorail vehicle floor plan according to an aspect of the present invention.
Figure 2B:
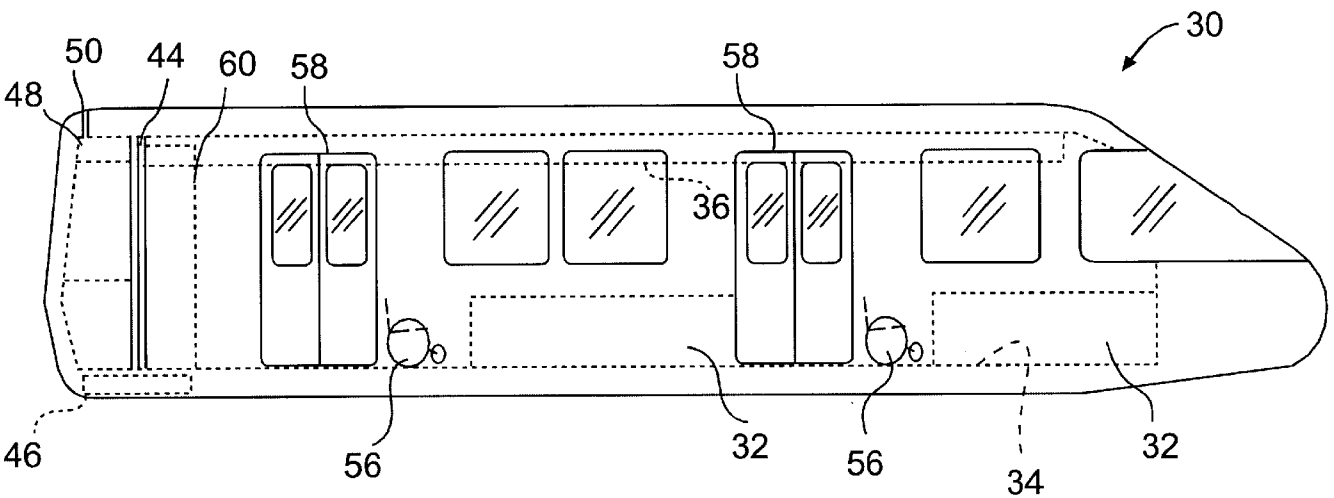

In FIGS. 2*a–2b* the cabin of a vehicle (30) is shown in floor plan and in elevation, respectively. Cabin is arranged to provide for floor level placement of carry-on baggage in baggage bins (32) on the floor (34) which allow passengers to retain control of baggage during intercity travel or during transfer from one station to another. Additionally, baggage bins (36) are arranged over passenger seating to allow for stowage of other articles, thereby maintaining visual control of baggage by passengers. For convenience, overhead baggage bins (36) have accommodations 38 for installation of individual passenger reading lights and air conditioning outlets for convenience of passengers. A variation of this arrangement is to install additional passenger seats in place of the on-floor baggage bins, and to install additional baggage bins over additional passenger seats. For simplicity the guideway and drive units (described below and in the previously incorporated U.S. Pat. No. 4,690,064) are not shown.

The rear of the cabin has toilet facilities including water closet (40) and lavatory (42) in a separate private enclosure (44). The water closet (40) may be a chemical type, sump type, or electric type. Waste held by the water closet (40) is retained in a fixed or removable container (46) beneath the cabin for servicing and cleaning from time to time with a gravity drain connection. Water supplies for the water closet and lavatory are located overhead or in a side wall in a gravity-fed tank (48) which is replenished from external connection (50) to a public water supply.

Seating of passengers is in individual seats (52) along one side of the cabin, leaving walking space between the seats (52) and baggage bins (32). As an option, backs of seats (52) may contain fold-down trays (54) for use with beverages or food service. Additionally, spaces for wheelchairs (56) are allocated on the floor of the cabin near entrances (58). Such spaces have restraints to provide security for wheelchairs during acceleration and deceleration.

An optional galley (60) located near the rear of the cabin (30) has facilities for holding refreshments which may be served to passengers. Additionally, this galley (60) would have provision for liquid waste drainage to the container (46). Food service facilities will comply with local health department regulations for food service, with potable water supply, available hand wash, and indirect drain to waste.

3. Dual-Sided Monorail Freight System

Figure 3B:
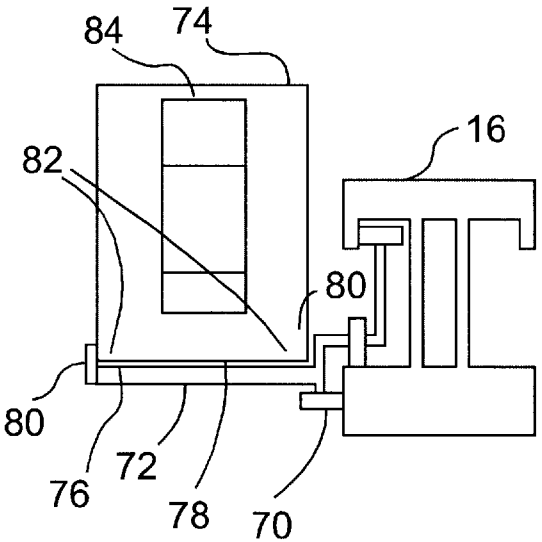
FIGS. 3*a* and 3*b* are a side elevation and an end view of a dual-sided monorail freight system according to an aspect of the present invention.
Figure 3A:
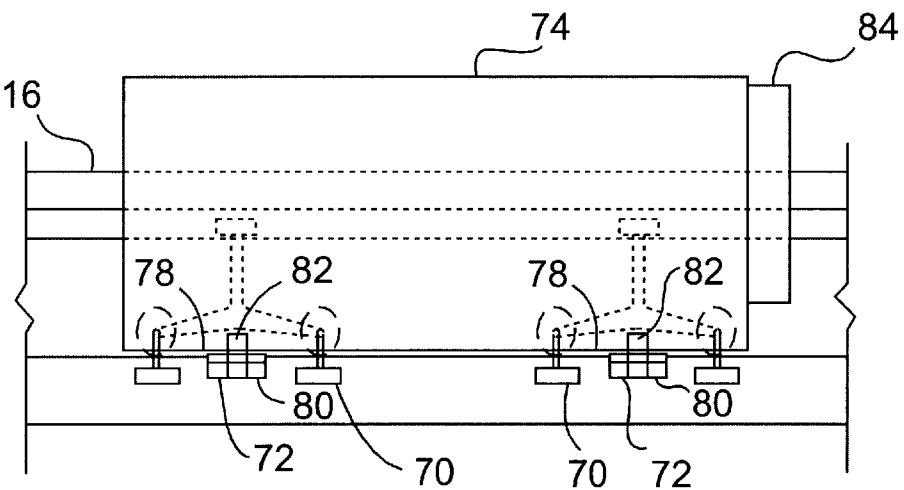

In FIGS. 3*a*, 3*b*, two guideway-mounted drive units (70) (may be only one, but preferentially a pair), similar to drive units with controls as described in U.S. Pat. No. 4,690,064 incorporated above, is modified to provide for laterally-extended arms (72) which support a removable freight container (74), similar to a freight container of a roadway van, which is placed in motion along guideway (16). The lateral arms (72) support the weight of a freight container (74) which is loaded onto the arms (72) by means of rollers or slides at (76) which bear on a support plate (78) at the bottom of the container (74) and held in place by latches at (80) and pins at (82) which slide in grooves in plate (78). Means is provided for full support of the container bottom plate (78) while the drive unit is in motion on the guideway, including on curved sections of guideways. Attachment of the container (74) to the drive unit (70) is preferably as described in sections 11 and 12 below. The drive units may or may not have refrigeration compressors and condensers (84) for refrigerating the containers while on the drive unit support arms (72). This freight enclosure may be as shown, but may also be an open gondola, or may be liquid carrier (as tanker), or may be bulk carrier, or may be configured for carrying long objects such as poles or beams. All features for control of the drive units and coupling of units is as given in U.S. Pat. No. 4,690,064 and described below. By preference, bottom supports are shown, but supports may be from the top as well. By preference a freight container is shown, but passenger cabins may be used as well with bottom support. As an option, the vehicle may have control means for determining its position on a guideway system and self-direct the vehicle to its final destination.

4. Vehicle Braking System Using Fixed Plate.

Figure 4:
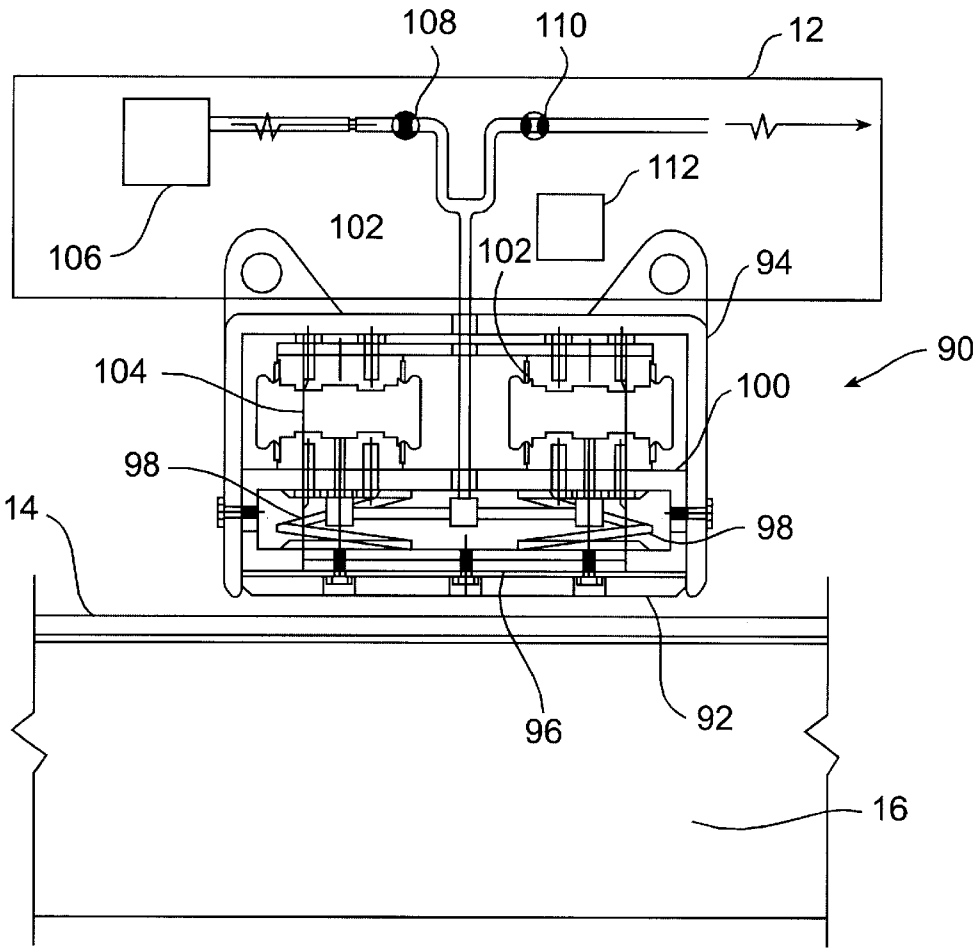
FIG. 4 is a side view of a vehicle braking system using a fixed plate according to an aspect of the present invention.

In FIG. 4 brake pads (92) apply pressure from a moving vehicle (12) to a continuous fixed guideway plate (14), or railway rail, such that the pressure from the vehicle brake pads (92) applied to the fixed plate (14) causes kinetic energy to be transferred from the moving vehicle (12) to the fixed plate (14) in the form of heat proportional to the mass of the vehicle and limited by the retracting force of an air or hydraulic control fluid applied to a retracting bellows and spring compression assembly. The brake system (90) consists of a brake housing (94), friction pad (92), shoe (96) for attaching friction pad and applying pressure to the pad, a set of springs (98) attached to apply pressure to the shoe (96), a base plate (100) against which the springs (98) press, a retracting means for retracting the shoe (96) and pad (92) from contact with the fixed guideway plate (14). The retracting means comprises air-operated actuator bellows (102) (two bellows are shown by preference for stability and capacity) disposed at the top of the base plate (100) and tension arms (104) coupled to the top free side of the bellows (102). Preferably, tension arms (104) are provided on both sides of the bellows (102). The system (90) also includes a source of air under pressure (106), such as a compressor, for activating the bellows (102), and air valves (108) and (110) for controlling the flow of air into and out of the air-operated actuator bellows (102). Air valves (108) and (110) may be operated manually or by means of external processes, such as by a computer or speed controller or automatic braking system. Air valves (108) and (110) may also be regulated by brake control system (112) which determines the rate of braking so as to limit or cause braking at a predetermined rate of change of vehicle velocity. An air operated system is shown, but hydraulic, chemical, magnetic or piezoelectric devices may be used to cause motion of the braking pads. The braking system (90) may be used on transit systems, railcars, magnetic levitation vehicles, and other moving apparatus.

In normal non-braking operation, allowing a vehicle with such a braking system firmly attached to it to move requires the closure of exit air valve (110) and opening of inlet air valve (108) to allow air from a compressed air source (106) to enter bellows (102), causing bellows (102) to expand to full extension, restrained by the physical geometry of the housing (94). As the bottom ends of the bellows (102) are constrained by the base plate (100), the upper free ends to which the tension arms (104) are coupled will rise as the bellows expand, such that tension arm (104) lifts brake shoe (96) with brake pad (92) from the rail plate (14) leaving an air gap between them, while compressing springs (98) to store energy.

In normal braking operation, a moving vehicle having such a braking system firmly attached to it would be stopped or slowed by opening of exit air valve (110) and closure of inlet air valve (108) allowing compressed air in bellows (102) to exhaust to atmosphere, thereby allowing bellows (102) to be retracted by the forces exerted by springs (98) on tension arm (104), while at the same time forcing brake shoe (96) with brake pad (92) against rail plate (14), causing brake pad (92) to rub against rail plate (14), with brake shoe (96) being restrained laterally and longitudinally by brake housing (94), with resulting friction and heat absorbing the kinetic energy of the moving vehicle.

In order to provide for passenger comfort and to protect from shifting of freight, limiting the rate of braking and vehicle deceleration is desirable. As an optional component of such a braking system, valves (108) and (110) would be operated by a deceleration-sensitive brake control system (112) which would sense the rate of vehicle deceleration and cause valves (108) and (110) to modulate the amount of air entering and leaving bellows (102) to modify the degree of retraction of brake pad (92) such that braking forces would be reduced by an amount sufficient to maintain a limited and variable braking rate.

Further, a group of such brake systems (90) sharing compressed air sources, valves, and controllers may be used to provide for a larger brake system for braking of larger moving vehicles against a fixed guideway plate. Additionally, very heavy braking loads may be accommodated by multiple braking systems on multiple fixed braking rails or surfaces. Further, partial application of a varying number of brake pads less than the total number of brake pads available might be used for partial or limited braking to satisfy the requirements of vehicle deceleration rate limiting as specified above.

5. Station Moving Platform For Loading, Unloading, and Servicing Vehicles.

Figure 5:
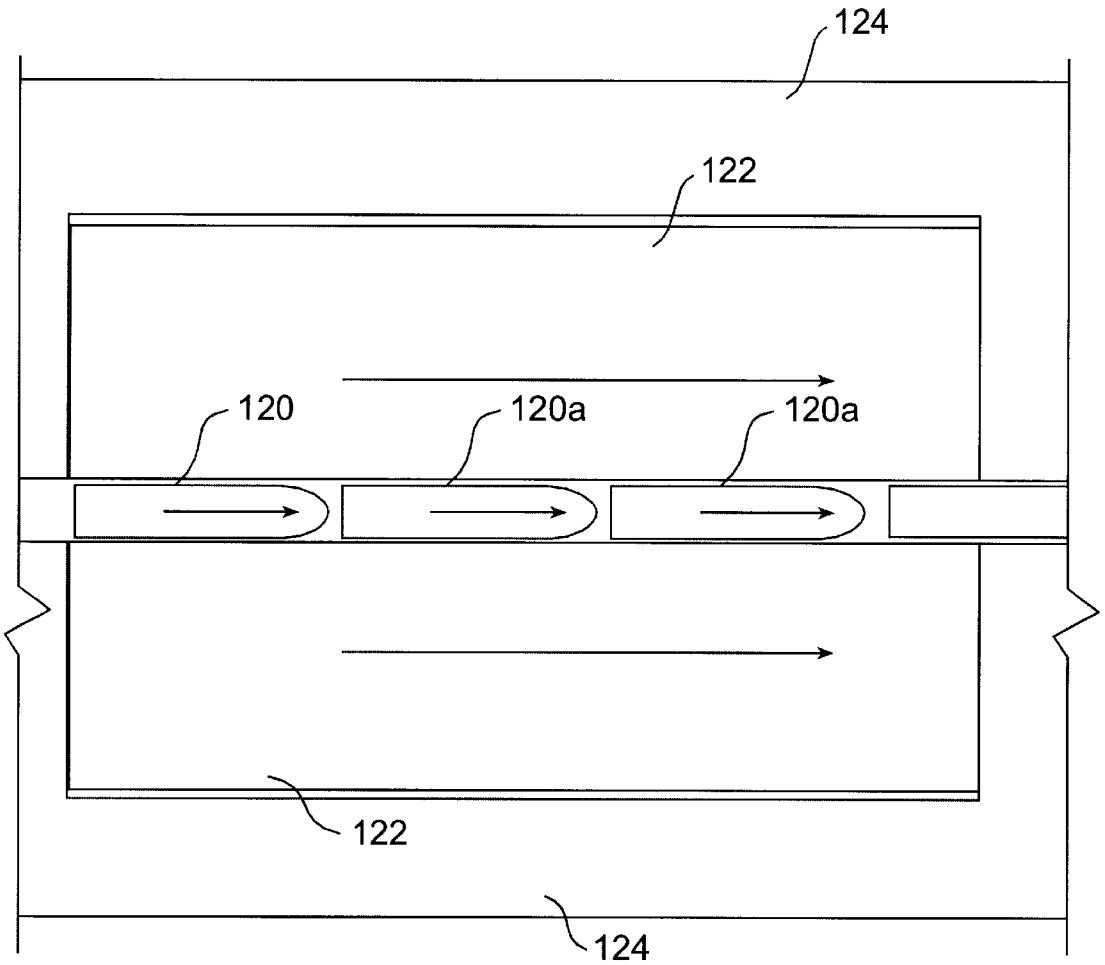
FIG. 5 is a schematic plan view of a moving platform for vehicle access according to an aspect of the present invention.

In FIG. 5 is shown a vehicle (120) which enters a station where passengers will be unloaded from the vehicle. Vehicle does not stop fully, but moves parallel to a moving loading platform (122) at a speed of equal to or less than normal walking speed of passengers. The parallel moving platform (122) has an adequate width and a length sufficient to unload and load passengers during a specified dwell time (time during which the vehicle is in the station). Platform (122) is preferably an upper flight of a continuous moving belt. When the vehicle (120) approaches the end of the moving platform (122) as in positions (120*a*) and (120*b*) passengers may continue to enter or leave the moving vehicle, there being no relative motion between the moving platform and the moving vehicle. Passengers may enter the moving platform (122) from fixed platform (124). The moving platform may be any length to accommodate desired dwell times and to accommodate frequently-arriving vehicles without reducing headway of vehicles between stations.

Further, unloading, vehicle servicing, and loading of vehicles may be accommodated by the same or a separate moving platform, either at a single platform or at multiple and separated platforms located in series or in parallel.

Further, a similar situation may be incurred in handling freight on a fixed guideway system, that is, the time to load or unload freight containers from a freight moving system on a guideway may be greater than the arrival interval time between multiple freight container-bearing vehicles. Accordingly, a similar system of moving unloading devices or unloading devices on a moving surface can be employed to remove freight containers from a vehicle as well as to load freight containers on a vehicle moving slowly through a freight station.

6. Method For Extending Effective Dwell Time of a Transit Vehicle in a Station.

Figure 6:
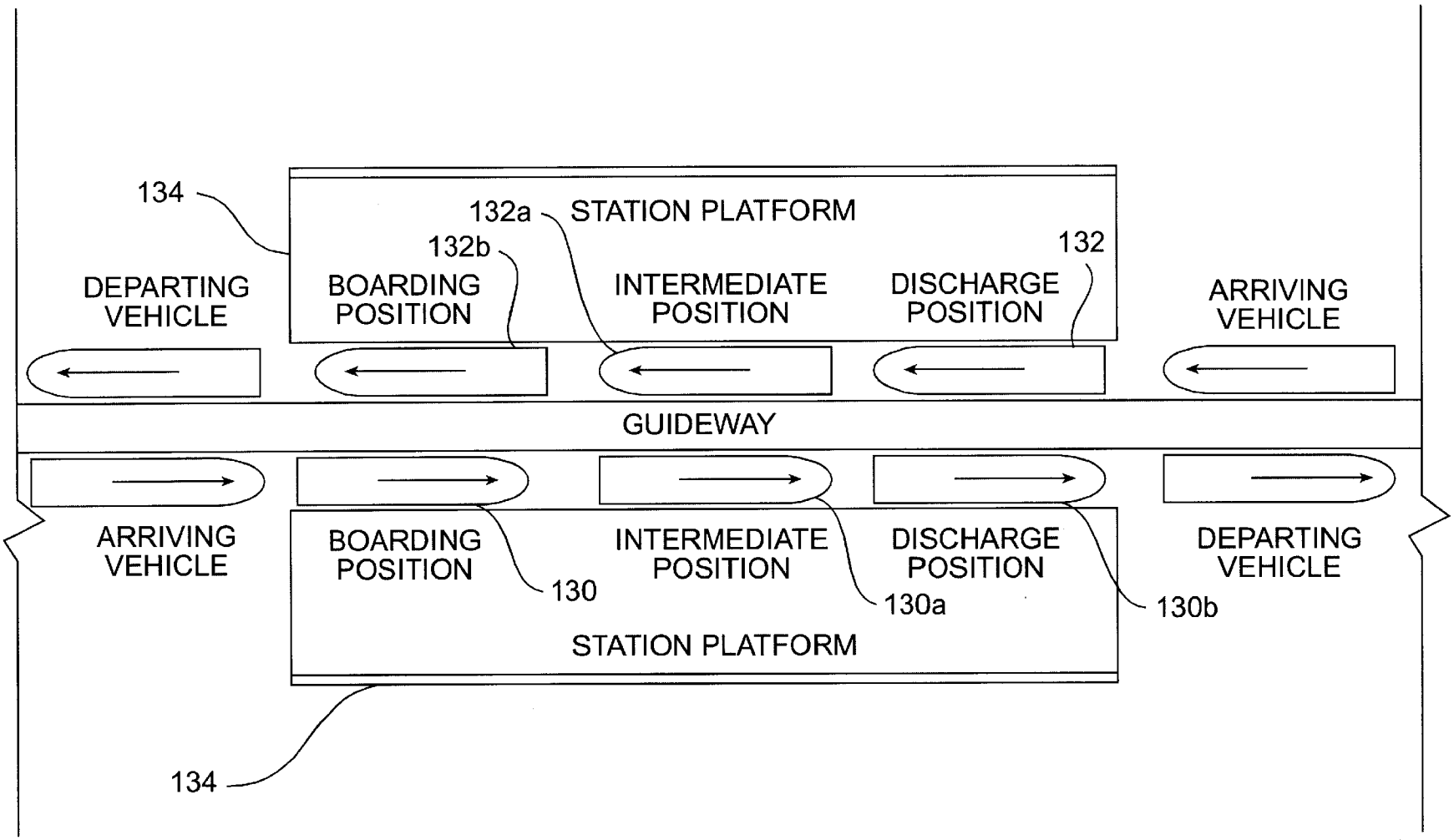
FIG. 6 is a schematic plan view illustrating a method for extending dwell-time of a transit vehicle in a station according to an aspect of the present invention.

In FIG. 6, vehicles (130, 132) are shown in a station (134) at a passenger discharge position having just arrived. The discharge position is used to discharge all or a lesser number of passengers, but not to load passengers which would take additional time. The vehicles (130, 132) then move to one or more intermediate positions (130*a*, 132*a*) depending on time requirements, en route to a boarding position (130*b*, 132*b*) which is used to board passengers for a time period before departing the station. The use of such multiple positions extends the effective dwell time of the vehicle in the station and allows the vehicle to have sufficient time to discharge and board passengers while maintaining short headway times. Moving platforms, such as described above, may be used in conjunction with this method to extend boarding and exiting dwell times.

7. Beam Stabilizer and Column Insert for Control of Movement.

Figure 7A:
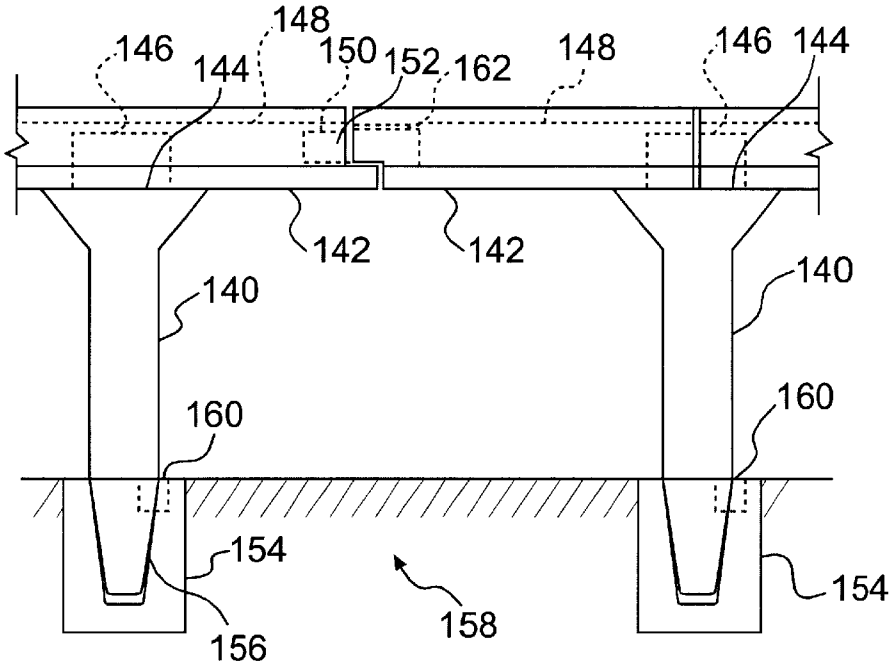
FIGS. 7*a*, 7*b*, and 7*c* are a side elevation, top plan, and end elevation view of a beam stabilizer and column insert arrangement illustrating a hollow beam for multiple uses according to aspects of the present invention.
Figure 7B:
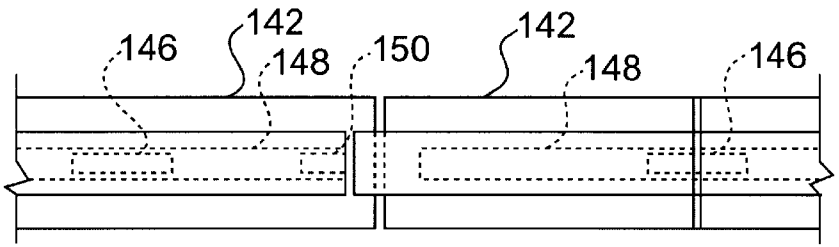
Figure 7C:
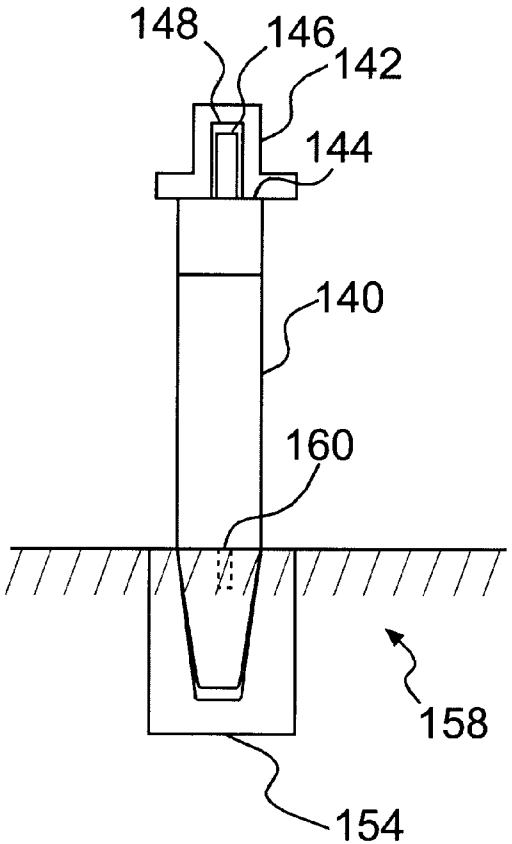

In FIGS. 7*a*–7*c* is shown a proposed arrangement is for a column (140) which supports beams (142) to have a top section (144), called a head, which supports the weight of one or more beams (142). An extension of the column (140) called an insert (146) continues from the top of the column head and is allowed to penetrate within a hollowed portion (148) of beams (142). The sides of a typical hollowed portion (148) of a beam anchor the beam to the column insert (146), restricting the lateral movement of the beam with respect to the column, without restricting linear movement of the beams (142). Surfaces of the beams and the supporting and restricting elements may, by preference, be isolated by conventional seismic and vibration isolating pads of neoprene or other material. An extension (150) of beam (142) extends and is inserted into a matching hollowed portion (148) of an adjacent beam (142) to allow beams to be continuous across beam end joints. A means, such as pins, through holes, or tongue and groove connection (152) may or may not be used to maintain vertical beam alignment.

Further, this arrangement will allow for the accurate placement of beams (142) on tops of columns (140) where tops are laterally inclined and not perfectly horizontal, or adjacent beams are not exactly co-linear, and will allow for lateral displacement of support columns during earthquake without allowing the beams to be dislodged from the column or each other.

Beams, columns, and structural components may be concrete, steel or other metals, fiberglass, wood or any other material suitable to carry the loads encountered.

8. Column Socket Insert System

In FIGS. 7*a* and 7*c* is shown a foundation socket (154) which will be dug or drilled into the soil or rock (158) at the placement site, having a form (156) of desired dimensions and shape for a matching column (140) which can be inserted within the hole or opening of the socket (154). The interior dimension of the form (156) will be equal to or greater than the outer dimension of a column (140) to be inserted into the socket. The depth of the excavation for the socket (154) will be established by a structural designer. The outer dimensions of the form (156) will be less than the inner dimensions of the excavation by an amount to be established by a structural designer. According to the requirements of the designer, reinforcing steel will be inserted into the space between the excavation and the socket form (156), and the space filled with concrete to form the socket (154). After curing sufficiently, the inner form (156) will be removed (or will be allowed to remain). A steel or pre-cast matching shape column (140) with column exterior dimensions less than those of the socket form (156) interior dimension will be inserted into the form opening of socket (154) and grouted or welded into final position, with a key extension or grouting slot (160) aligned between the column (140) and the concrete foundation socket (if so selected as an option).

Further, the column (140) may contain electrical power or control or communication conduits for convenience in wiring of power or control or communication systems.

Further, the column (140) may be shaped in any form, including circular, oval, square, rectangular, or any other shape desired by the designer. The form (156) will be of a shape to match the shape of the column, or may be shaped differently so as to allow foundation space for conduit, drains, shimming devices, or grout for retention of the column in the space.

Further, the column may be shaped to include an insert extension (146) at the top of the column to be used as a beam retention device.

9. Hollow Beam for Multiple Uses.

Cast concrete, fiberglass, or fabricated wood or steel beams for transit systems guideways, for roadways, for bridges, and for buildings may be cast or built as hollow structures for structural reasons, but may be used further as earthquake resistant enclosures to protect and restrain lateral movement of wires, fiber optic cables, conduit, pipes, tubes and cables, and for gases and liquids. Further, such enclosures can conceal items within from view, adding to the visual attractiveness of the total structure. Openings in solid beam insert ends can provide for continuity of wires, conduit, pipes, tubes, cables and for gases and liquids across beam ends.

In FIG. 7*c*, a beam (142) is shown with a hollow core (148) having an insert socket (146) at each end for beam stabilizing column inserts. Further, the core (148) of the hollow beam may be designed with conduit, or channels, located at a top portion (162) of the core (see FIG. 7*a*) for pipes, wires and light guideways, and for gases and liquids which will be protected from weather and will have benefit from more earthquake-resistant construction.

10. A Device for Connection and Control of Multiple Vehicles and Drive Units.

Figure 8:
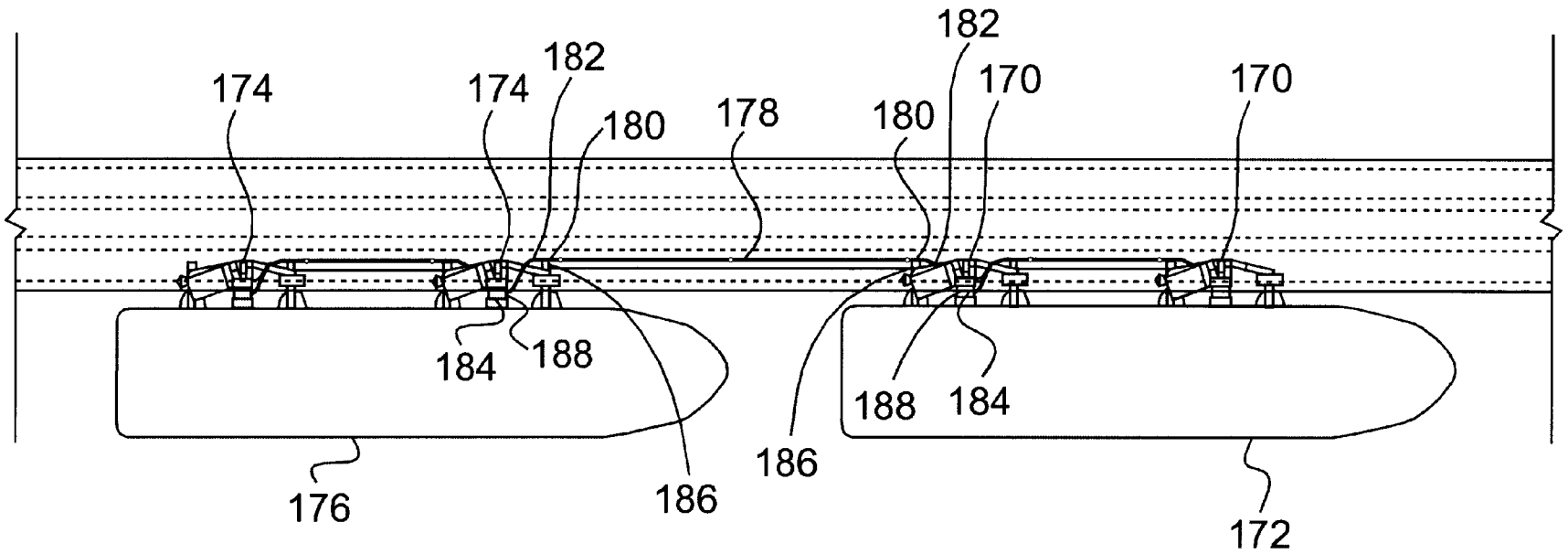
FIG. 8 is a plan view of a mechanism for connection and control of multiple monorail drive units according to an aspect of the present invention.

In FIG. 8 drive units (170) of a lead vehicle (172) on a dual-sided monorail system are connected to each other and to drive units (174) of a following vehicle (176) by mechanical linkages consisting of rigid bars (178) with universal joints (180) at each end. Additionally, each bar (178) has means for supporting electrical, optical, or mechanical control cables (182) which connect motor controllers (184) on drive units (701) and (174) to run as matched pairs and as one entity at the same speed as that commanded by the control system of the lead vehicle (172) or matching drive unit. Each bar (178) is of such length as to prevent all parts of the adjacent transit vehicles from touching another transit vehicle or the adjacent guideway.

Further, each bar (178) shall have quick connecting devices (186) and control cabling couplings (188) at each end for quickly connecting and disconnecting drive units.

11. Drive Unit Coupling To a Transit Vehicle With Displacement of Supporting Arms On the Vehicle.

Figure 9C:
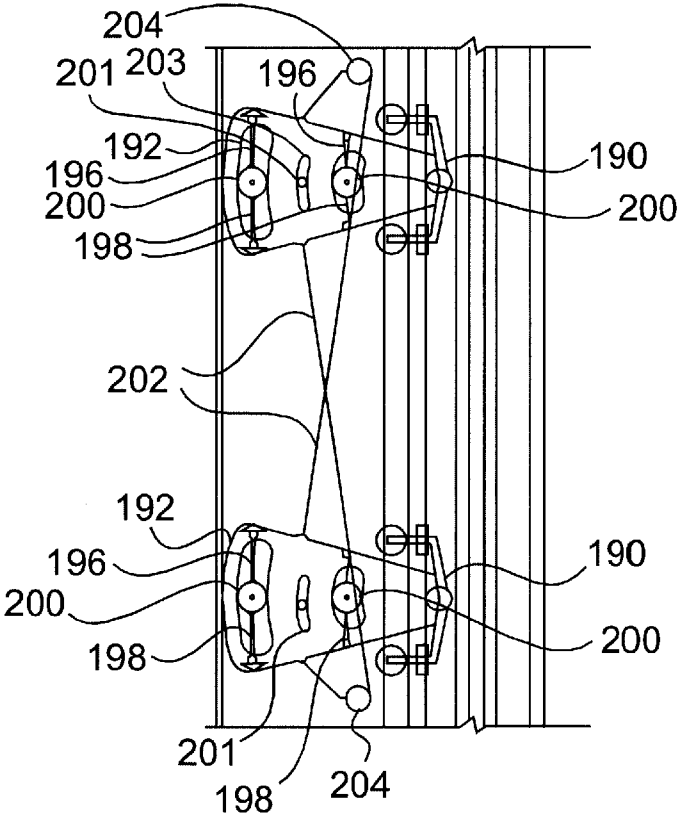
FIGS. 9*a*, 9*b*, and 9*c* are a side view, top view, and end view of a drive unit coupling according to an aspect of the present invention.
Figure 9A:
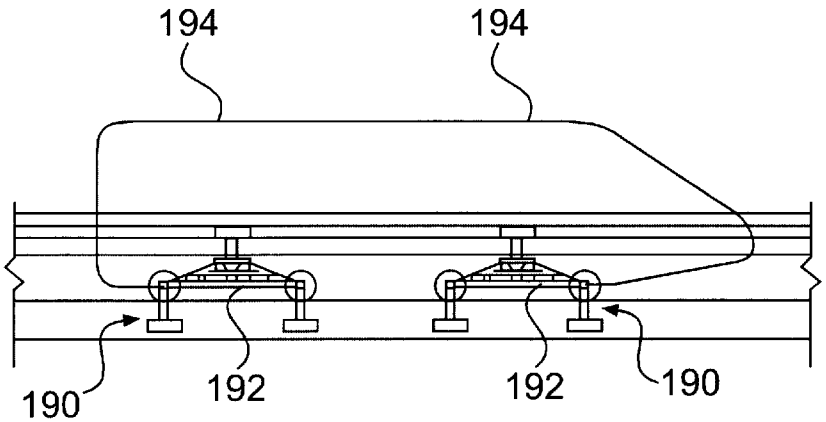
Figure 9B:
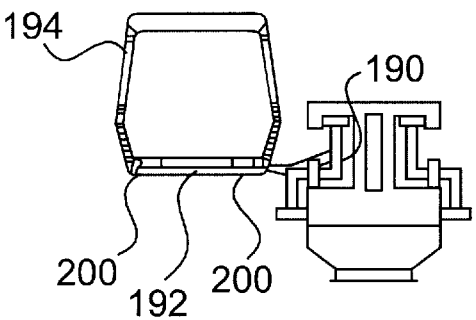

In FIGS. 9*a*–9*c* a drive unit (190) of a dual-sided monorail system vehicle has a support arm (192) which extends to support the cabin or freight container (194). One or more thrust bags or hydraulic thrust columns (196) take the thrust of the drive unit (190) and apply that force to the cabin or container (194). Similarly, braking bags or hydraulic braking columns (198) apply the braking forces from the drive unit (190) and apply it to the cabin or container (194). As support arm (192) pivots, it compresses gases in thrust bags and columns (196) and braking bags and columns (198), thereby storing energy for returning the pivoting arms to a normal parallel relationship for straight guideway operation.

The thrust and braking bags (196) and (198) also serve to dampen longitudinal vibration between the drive unit (190) and the cabin or container (194). Additionally, the support arms of the drive units have vertical support wheels, rollers or sliding pads to apply vertical force upward on the cabin air support bags (200) or underside of the cabin or freight container and thereby support the weight of the cabin or container, while also allowing the varying angular motion of the support arms (192) to operate without resistance, thereby providing for the whole vehicle assembly to operate on curved guideways as well as on straight guideways. Support arms (192) so pivoting are shown in the section drawing so as to maintain support applied to the underside of the cabin support air bags (200) with support to the underside of the freight container similarly. Support arms (192) may include arcuate slots (201) to receive fixed vertical pins (203) on the vehicle so as to maintain a fixed distance of the vehicle from the guide way.

Similarly, vertical hydraulic thrust columns (shock absorbers) are used to dampen rates of vertical movement of the vehicle cabin supported by cabin air support bags.

Cable or articulated bars (202) attached to the support arms (192) and passing around tension balance idler wheels (204) may be used to provide for coordinated mirrored (opposite) motion of two drive units so that the vehicle cabin or container may be equally supported by the drive units.

The bags may contain air or they may be filled with other gases or gas mixtures, and may have variable pressures continually adjustable by manual, hydraulic or other automatic means for variations in loads and passenger comfort. Springs or hydraulic actuators may be used instead of air bags if desired. Further, air bags may be cloth, rubber, plastic, or telescoping steel, other metal or plastic enclosures. By preference, telescoping steel hydraulic shock absorbers are shown for thrust and braking purposes and rubber impregnated cloth is shown for cabin and container air support bags.

12. Drive Unit Coupling to a Transit Vehicle With Displacement of Supporting Arms On the Vehicle (Alternate Arrangement).

Figure 10B:
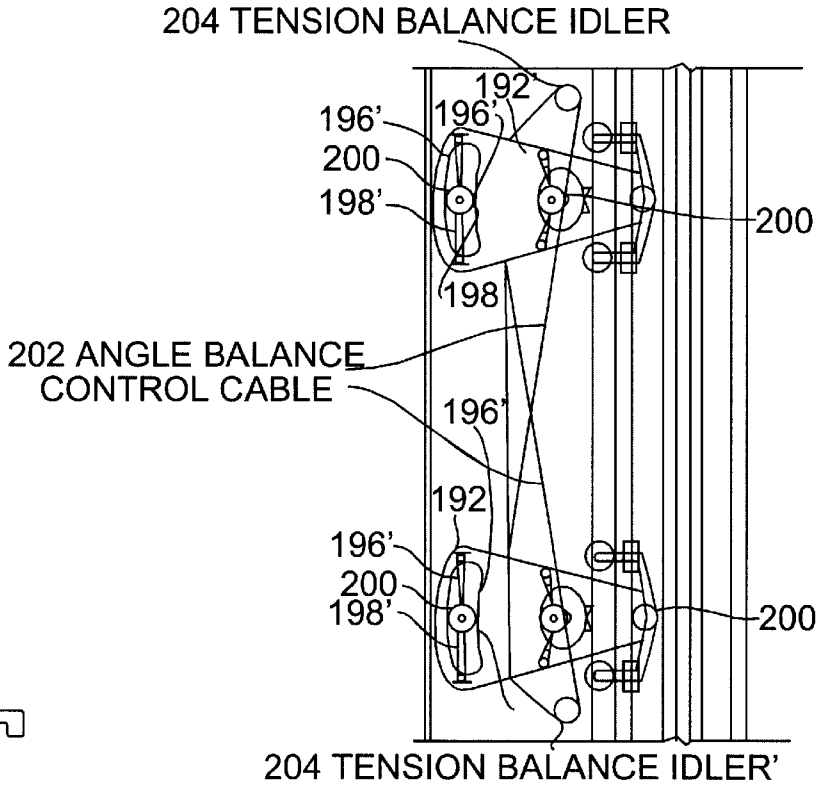
FIGS. 10*a*, 10*b*, and 10*c* are a side view, top view, and end view of an alternate arrangement of a drive unit coupling according to an aspect of the present invention.
Figure 10A:
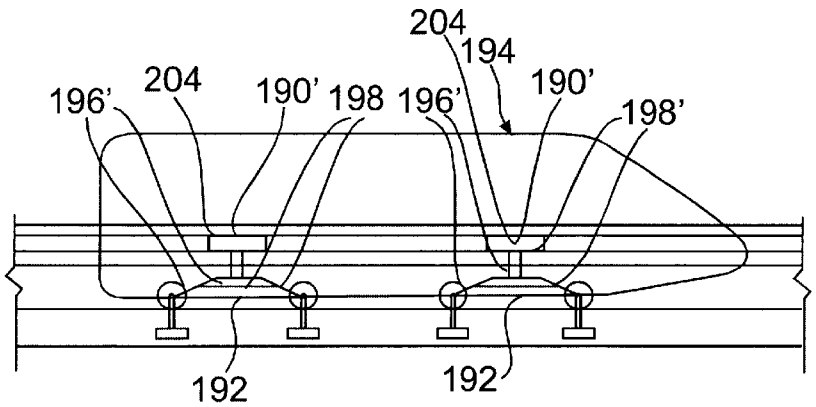
Figure 10C:
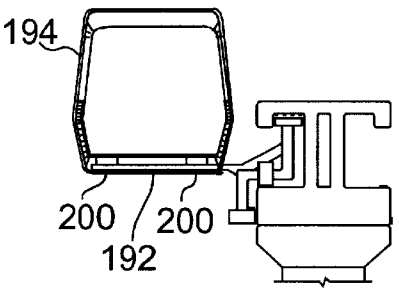

In FIGS. 10*a*–10*b*, a drive unit (191') of a dual-sided monorail system vehicle has a support arm (192') which extends to support the cabin or freight container (194). One or more thrust bags or hydraulic thrust columns (196') take the thrust of the drive unit (191') and apply that force to the cabin or container (194). Similarly, braking bags or hydraulic braking columns (198') apply the braking forces from the drive unit (191') and apply it to the cabin or container (194). As support arm (192') pivots, it compresses gases in thrust bags and columns (196') and braking bags and columns (198'), thereby storing energy for returning the pivoting arms to a normal parallel relationship for straight guideway operation.

The thrust and braking bags (196') and (198') also serve to dampen longitudinal vibration between the drive unit (191') and the cabin or container (194). The support mechanism for the cabin or freight container (194) is the same as that shown in FIGS. 9*a*, 9*b*, and 9*c*.

Cable or articulated bars (202) attached to the support arms (192') and passing around tension balance idler wheels (204) may be used to provide for coordinated mirrored (opposite) motion of two drive units so that the vehicle cabin or container may be equally supported by the drive units.

Similarly, vertical hydraulic thrust columns (shock absorbers) are used to dampen rates of vertical movement of the vehicle cabin supported by cabin air support bags.

Bags containing air are shown, but bags may be filled with other gases or gas mixtures, and may have variable pressures continually adjustable by manual, hydraulic or other automatic means for variations in loads and passenger comfort. Springs or hydraulic actuators may be used instead of air bags if desired. Further, air bags may be cloth, rubber, plastic, or telescoping steel, other metal or plastic enclosures. By preference, telescoping steel hydraulic shock absorbers are shown for thrust and braking purposes and rubber impregnated cloth is shown for cabin and container air support bags.

13. A Mechanism For Automatic Leveling Of a Rail Vehicle.

Figure 11:
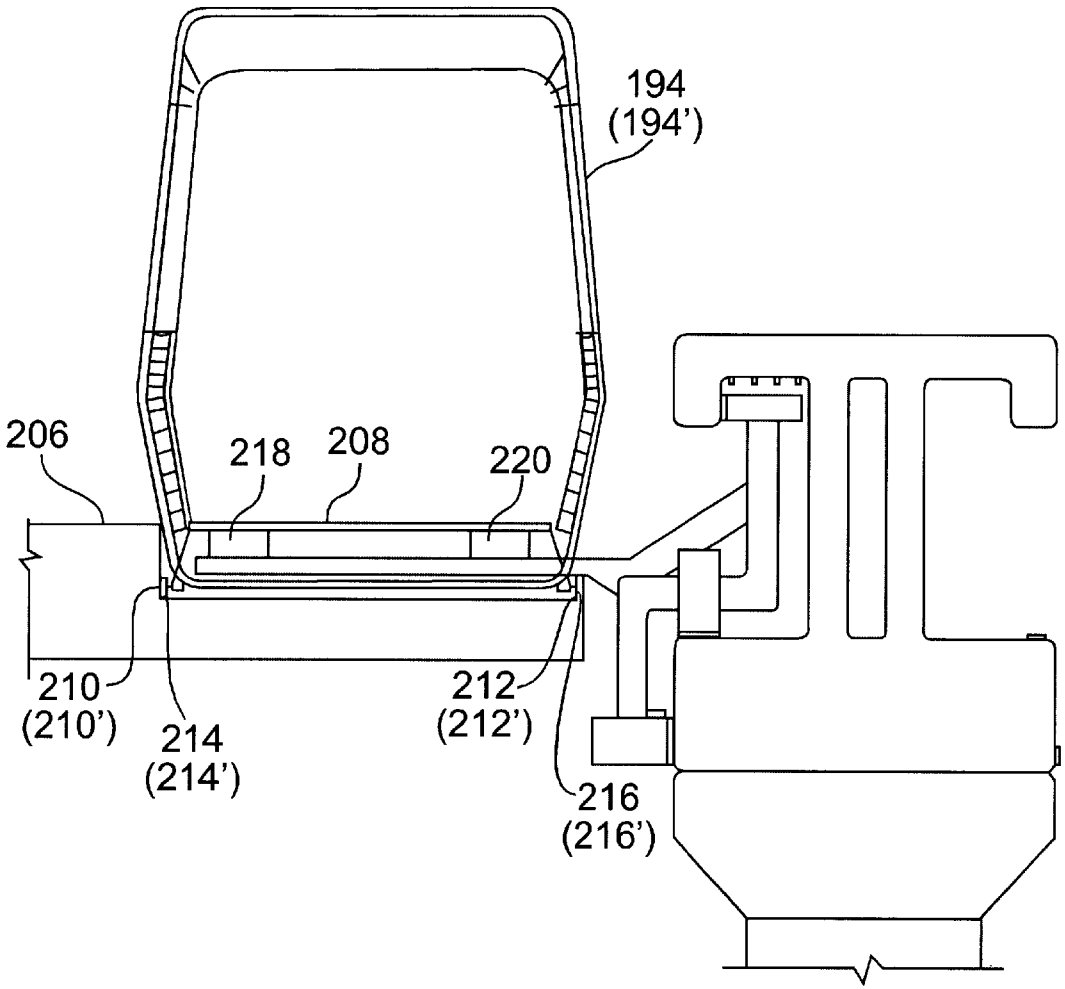
FIG. 11 is an end view of a mechanism for automatically leveling a rail vehicle with respect to an adjacent platform.

In FIG. 11 a vehicle including cabin or container (194) enters the station and approaches platform (206) with the floor (208) of the transit vehicle cabin not at the same elevation or co-planar with the platform (206). Mechanical guides (210) and (212) on the sides of the vehicle engage mechanical racks (214) and (216) on the station platform and the side of the guideway beam as the vehicle remains driven in forward motion, thereby forcing the vehicle cabin (194) upward at the mechanical guides in the stopped loading and unloading position, thereby holding the vehicle cabin (194) level during unloading and loading. During departure from the station the reverse occurs, with the mechanical guides (210) and (212) remaining on the mechanical tracks (214) and (216) until the vehicle (194) is out of the loading platform (206) area at which time the guides disengage from the tracks and the vehicle assumes a normal position. Guides (210) and (212) are shown at the front of the vehicle, but matching guides are employed at the rear of the vehicle to maintain fore-an-daft level conditions.

As an alternate in FIG. 11, a vehicle enters a station with the floor of the cabin not at the same elevation as or co-planar with as the station platform. Mechanical devices (210') and (212') on the vehicle cabin (194') engage matching calibrated contact points (214') and (216') on the station platform which touch the mechanical devices causing each device in turn to open a compressed air source on the vehicle to inflate support bags (218) and (220) sufficiently to lift the vehicle cabin to a position which is level and coplanar with the station platform (206). Upon leaving the station, the centrifugal force and leveling detector (described below) will resume control of the elevation and tilt system for the passenger cabin (194'). While mechanical sensors and controls are described, control sensors may be electrical, magnetic sensing, or optical and may be further enhanced by computer control of hydraulic fluid, screwjacks, compressed air or other pressurized gas activating source. The compressed air used may be from a system of the vehicle which provides compressed air for other purposes such as for brakes or door operation.

14. A Mechanism For Automatic Leveling and Banking Of a Moving Vehicle.

Figure 12:
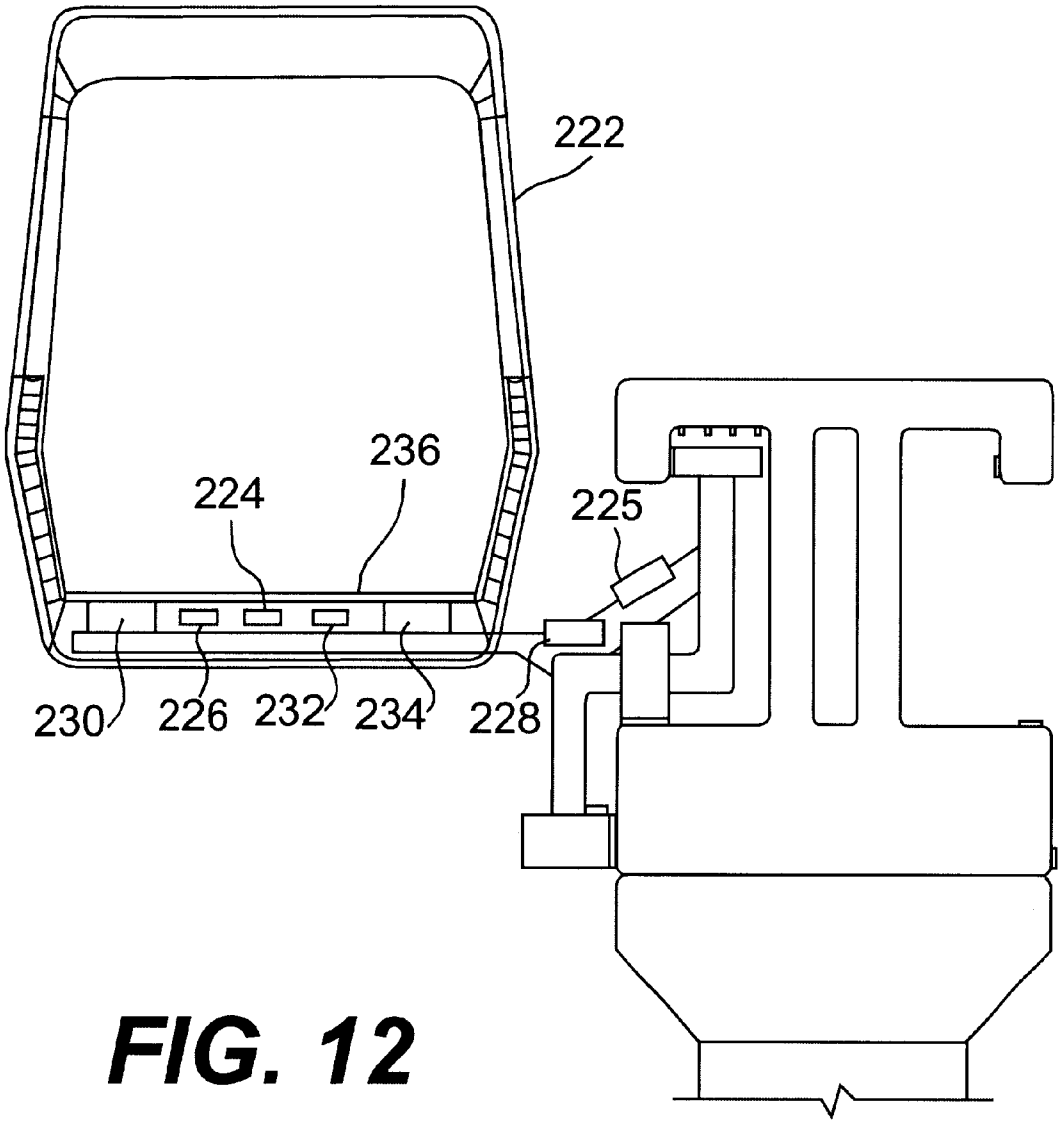
FIG. 12 is an end view of a mechanism for automatic leveling and banking of a moving monorail vehicle according to an aspect of the present invention.

In FIG. 12, a vehicle with passenger cabin (222) enters a curve with centrifugal forces applied laterally on the passenger cabin (222). As the centrifugal forces are sensed by a swinging pendulum sensor or accelerometer or other similar centrifugal force detector system (224), signals from the detector (224) are directed to a controller (225) which opens compressed air valve (226) allowing a compressed air source (228) to inflate support bag (230) to a higher pressure than normal, lifting that side of the cabin (222) from a level position. At the same time, the controller (225) opens an atmospheric bleed valve (232) to reduce the internal pressure of support bag (234) allowing the bag to deflate, lowering that side of the cabin (222) from a level position. The detector system (224), sensing the amount of centrifugal force applied to the cabin, inflates and deflates the support bags (via the controller (225)) as necessary to cause the cabin floor to tilt, thereby accommodating the passenger comfort by making all passengers sense lateral forces perpendicular to the floor (236) while the vehicle is on the curved portion of the guideway. After the curved portion of the guideway is passed by the vehicle, the centrifugal force detector system (224) senses no centrifugal, so the controller (225) then causes the support bags (230) and (234) to return to their normal inflation. For illustration only one pair of support bags is presented. By similarity, two sets of support bags will work as a complete system. The compressed air source for operation of the system may be separate or from a system of the vehicle which uses air for other purposes such as for brakes or door operation. Hydraulic fluid may be used instead of compressed air or other gases.

As an alternative to a centrifugal force sensor, a computer system having data inputs of vehicle velocity along the guideway and knowledge from a data base or guideway identifier signal or optical identifier indicating the curvature of the guideway section being encountered may calculate the amount of cabin tilting required to maintain passenger comfort and subsequently inflate and deflate hydraulic actuators or air bags to maintain that comfort.

Additionally, the artificial banking effect of the system allows the designers to reduce the cost of construction of high speed guideway systems without higher costs of construction of special banked guideways for curves.

15. Emergency and Maintenance Services Guideway Vehicle

Figure 13:
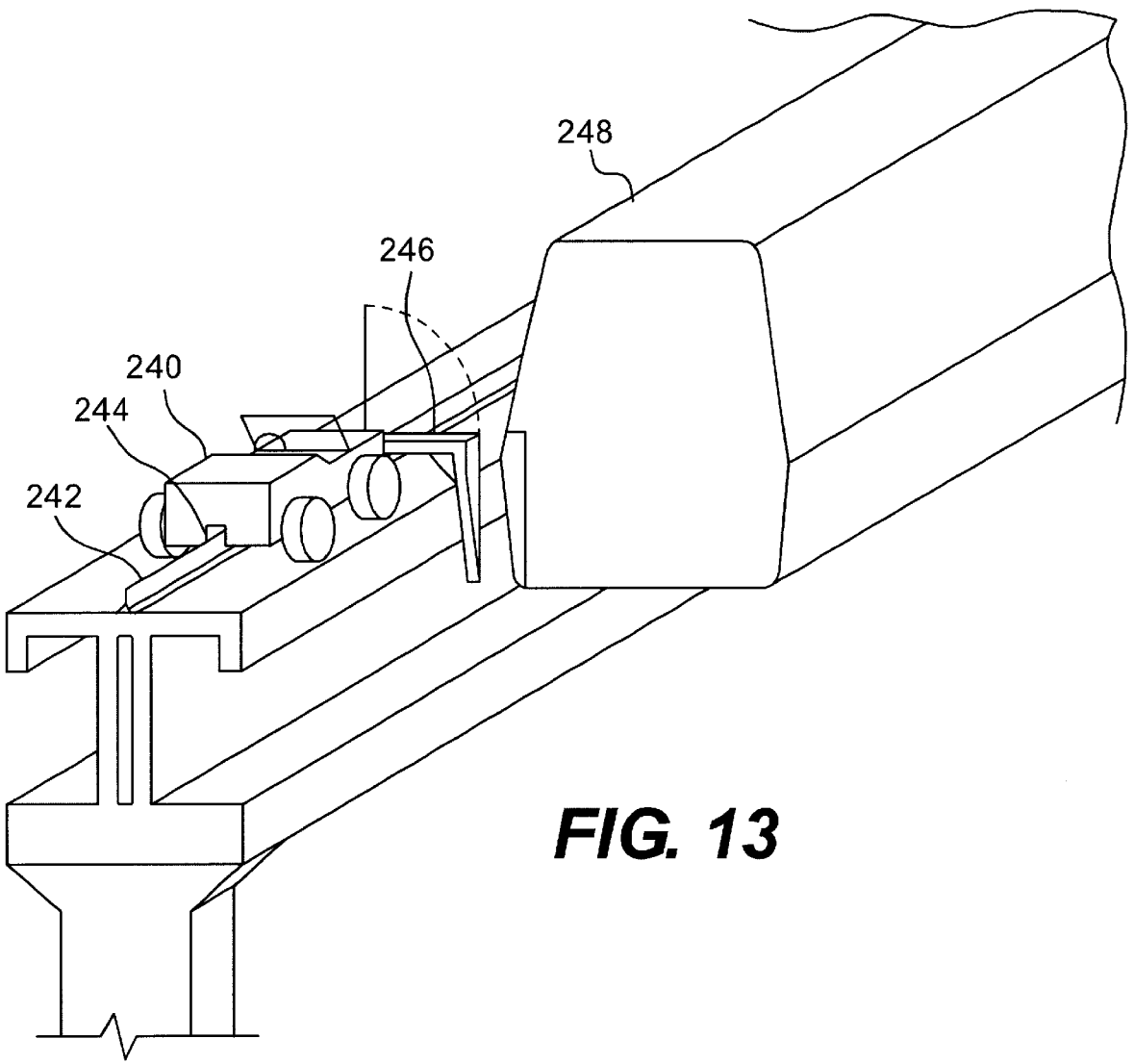
FIG. 13 is a perspective view of an emergency and maintenance services guideway vehicle for a transit system according to an aspect of the present invention.

In FIG. 13 a vehicle (240), which may be any sort of vehicle other than those used as drive units, passenger cabins, or freight containers, as referenced herein, is employed to move disabled transit drive units independently or to move vehicle drive units with passenger cabins or freight containers attached to a selected location. By preference the auxiliary vehicle is shown as an emergency drive unit, a vehicle powered by electricity, gasoline or diesel engine with rubber tires (but may be steel wheels on rails or magnetic levitation and propulsion) which is driven by a human operator (but may be automated) to the location of such a disabled vehicle. The vehicle may be used to support maintenance and inspection services. The auxiliary vehicle is steered by the operator on the top of the guideway or may be steered by a guide-rail (242) with mechanical followers (244) or electrical or electronic guiding sensors or may be steered by another means such as lighted path or magnetic sensing device.

When at the location of the disabled vehicle, the auxiliary vehicle (240) extends an arm (246) which is attached to the auxiliary vehicle and which rotates about an axis or slides in a track such that it engages a portion of the disabled vehicle (248) or one of its drive units and attaches itself with a removable clamp, socket, or other device sufficient to transmit pushing or pulling forces to the disabled vehicle (248) to provide motive and braking forces from the auxiliary vehicle to the disabled vehicle. Motion of the auxiliary vehicle and braking on the auxiliary vehicle will provide motion and braking for the disabled vehicle. Also, auxiliary computer controls systems on the auxiliary vehicle may be connected to the disabled vehicle for control of drive motors, brakes, or other disabled vehicle systems.

Further, the auxiliary vehicle may be configured as a fire-fighting vehicle, emergency medical services vehicle, or passenger evacuation vehicle, as independent vehicles or as a combined services vehicle.

16. Articulating Vehicle For Transporting Heavy and Long Beams.

Figure 14:
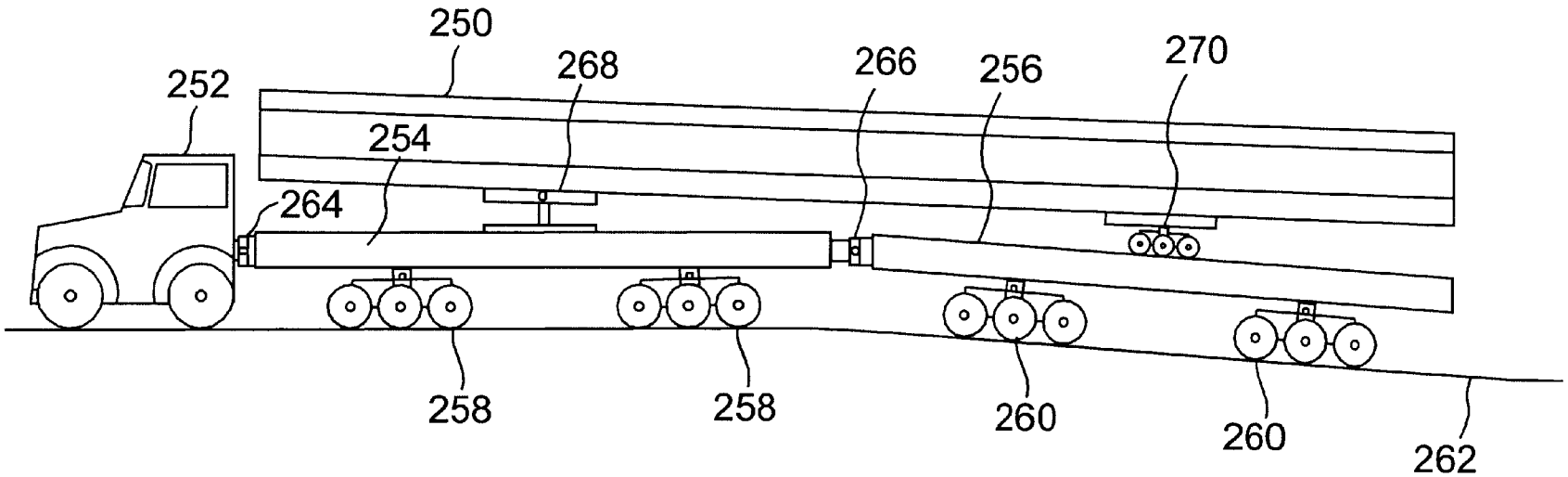
FIG. 14 is a side view of an articulating vehicle for transporting beams according to an aspect of the present invention.

In FIG. 14, a beam (250) is being transported by a tractor (252) which tows a trailer pair (254, 256) which are supported by wheels (258, 260) which bear on roadway (262). The trailers are free to articulate around towing connections (264, 266), which allow articulation in all directions. The beam (250) is supported by the front trailer section (254) with a pivoting support bed (268) which can rotate in vertical and horizontal planes, and with a rolling or sliding and pivoting support bed (270) which is restrained laterally and can rotate in vertical and horizontal planes but can move only linearly along the length of the rear trailer section (256). Both supports (268) and (270) support the beam to prevent rocking motion laterally. A sufficient number of wheels and tires are used to avoid damage to roadways and to operate tires within normal design load limits.

A benefit of this arrangement is that long and heavy beams can be carried without damage to roadways. Another benefit is that beams can be carried on roadways with undulating surfaces without damage to the trailers and loads on trailer tires can be minimized. By extension of the design to provide for exceptionally long beams, additional trailer sections can be used as additional elements of a train of trailer sections.

Further, this arrangement can be used for transport of long and heavy items on surface railways or elevated monorail systems by using a similar trailer arrangement with a means for providing movement.

17. Means For Information Transfer Between a Fixed Position and a Moving Transit Vehicle.

Figure 15:
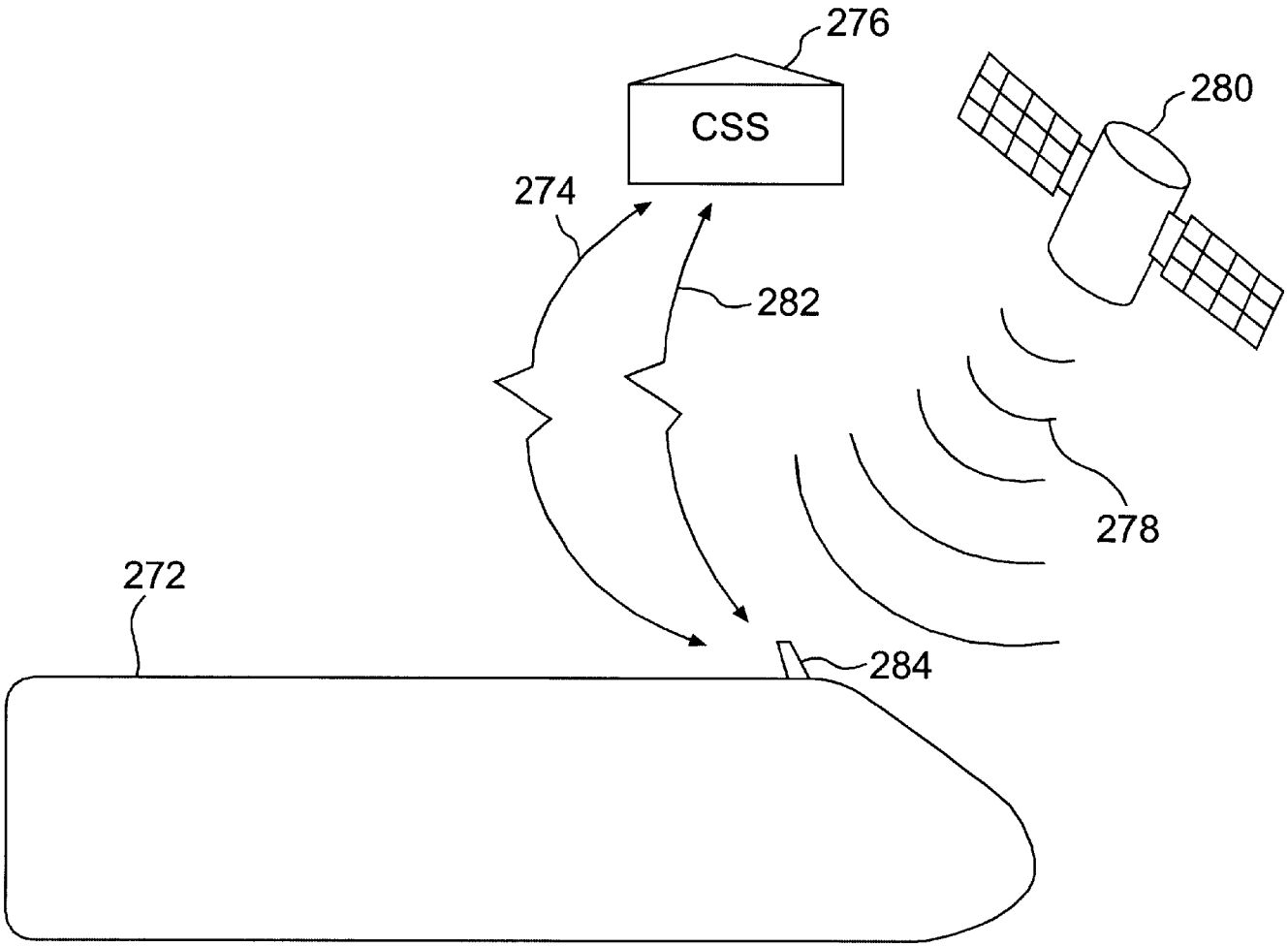
FIG. 15 is a schematic view illustrating a system for information transfer between a fixed position and a moving transit vehicle according to an aspect of the present invention.

In FIG. 15, a moving vehicle (272) is shown with the following communicating devices installed: a wireless digital link (274) from a central supervising station (276) to the vehicle, a wireless digital link (278) from a geosynchronous positioning satellite geographical locating system (280) which sends Earth surface location information, a wireless digital link (282) from the vehicle (272) to the central supervising station (276) with location data, control and operation data, video images, voice, vehicle performance data and other information as needed by the central supervising station, security, management, and maintenance personnel. An antenna (284) mounted internally or externally on the vehicle is used for wireless signal sending and receiving. The digital links are carried by commercial data services with encoding devices at each end of the data links. Each data link is identified by vehicle identification signals to control receiving and sending pathways. Signal repeaters are used as needed to communicate when the vehicle is in difficult reception zones.

18. Articulating Cabin Dual-Sided Monorail Vehicle

Figure 16A:
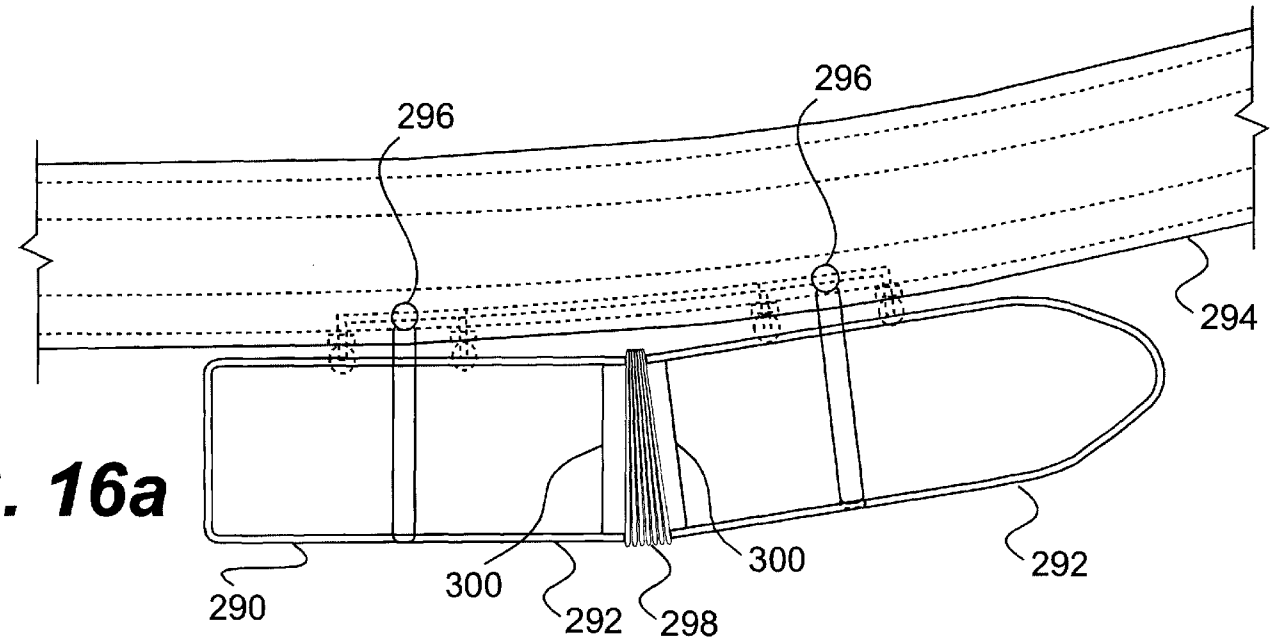
FIGS. 16*a* and 16*b* are a top plan view and a side view of an articulating cabin dual sided monorail vehicle according to an aspect of the present invention.
Figure 16B:
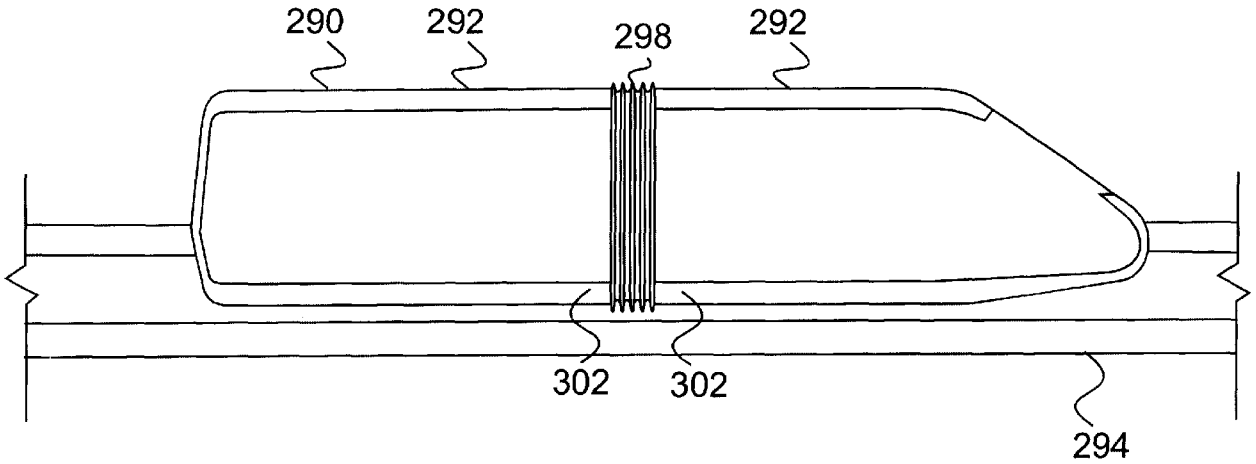

In FIGS. 16*a*–16*b*, a dual-sided monorail vehicle (290) is shown with an articulated cabin (292) mounted on a curved guideway (294). The drive units (296) are shown directly coupled to the cabin sections and do not move with respect to the cabin sections. A flexible joint (298) connecting adjacent cabin sections is made with flexible sidewalls and sliding overlapping ceiling and floor plates (300, 302). Electrical and control cables are flexible between the cabin sections to provide for angular and linear relative motion of the sections. A guideway curved in one direction is shown, but cabin articulating arrangement for curvature in another direction is similar. Although an articulating cabin of two sections is shown, three or more similarly connected cabin sections may be used for the vehicle.

19. Method For Providing Transit System Passenger Continuation To Destination

An alternative arrangement with a transit authority is made such that a transit passenger can either (a) lease a personal-use reserved automobile for regular daily service from the destination transit station or (b) rent a personal-use reserved automobile for occasional service from the destination transit station. Since such a vehicle used for this limited service would accumulate mileage at a very slow rate, vehicle lease cost would be low. Lease rates would include insurance and routine maintenance, with fuel purchased by the user. Low hourly short-distance rental rates would include fuel, insurance and routine maintenance, with the vehicles fueled by an attendant. Arrangement for rental would be through pre-arranged regular use plans. Automobiles are listed, but similarly bicycles, motorcycles, boats, aircraft, motor scooters, golf carts, and other engine or electric motor propelled vehicles can be used as well.

Transit patrons can use transit systems and continue to final destinations by use of alternative vehicle leasing or rental arrangements. This allows patrons to avoid high costs of vehicle ownership while retaining all advantages of ownership. It allows the community to reduce vehicle emissions by as much as 90% while retaining the economic advantages provided by private automobile usage. Its low cost allows the transit system to attract more passengers and fulfil its need to increase revenues from passenger numbers as well as fulfil its mandate from governments to reduce vehicle fumes emissions within the community.

20. Mechanism For Positive Traction On a Steel Rail

Figure 17B:
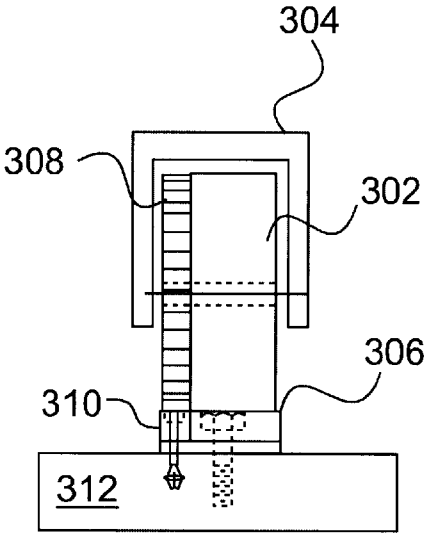
FIGS. 17*a* and 17*b* are a side view and end view of a mechanism for positive traction on a steel rail according to an aspect of the present invention.
Figure 17A:
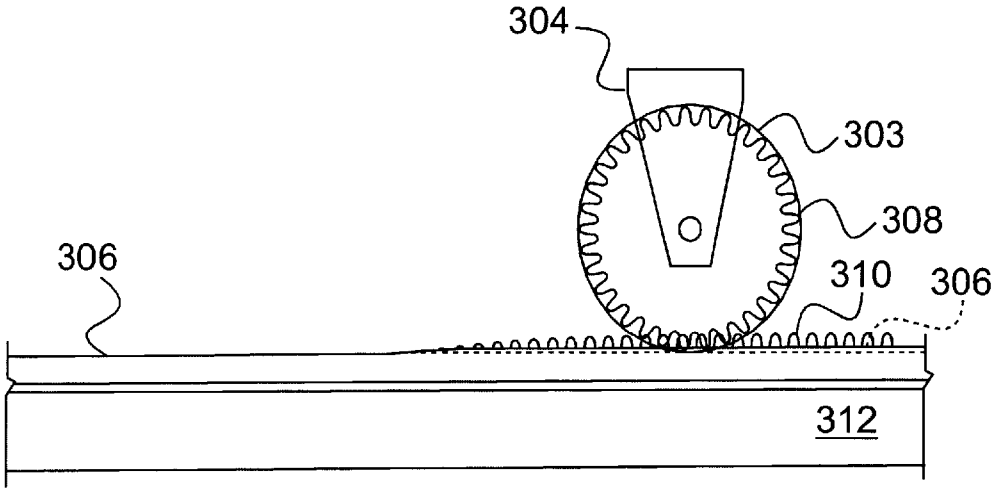

In FIGS. 17*a, b*, a drive wheel (303) on a vehicle (304) is shown on a steel rail (306). A grit surface or geared surface (308) is provided on a side portion of the drive wheel (303) and a matching grit surface or geared surface (310) is provided on a side portion of a rail mounted on a guideway or rail supports (312). The diameter of the drive wheel grit surface and geared surface is less than the diameter of the drive wheel. When the drive wheel engages a portion of the rail which has a slope greater than a selected slope, such as + or −7%, the grit surface or geared surface of the drive wheel engages a matching grit surface or geared surface of the rail and the motive force of the vehicle drive wheel changes from steel-on-steel friction to positive engaged traction. As a result, the vehicle is capable of ascending or descending grades greater than those possible using steel-on-steel friction. For ease of engaging the geared surface, the geared portion of the rail is shown to gradually engage the geared portion of the wheel, allowing for synchronizing the meshing of gear teeth.

21. Dual-Sided Monorail Station at Grade

Figure 18:
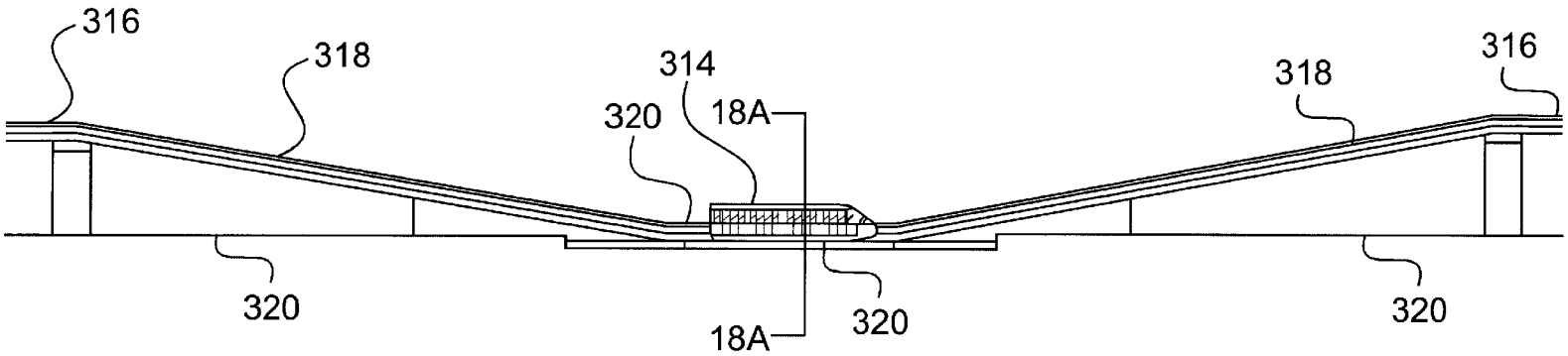
FIG. 18 is a side view of an at-grade-station for a dual-sided monorail according to an aspect of the present invention.
Figure 18A:
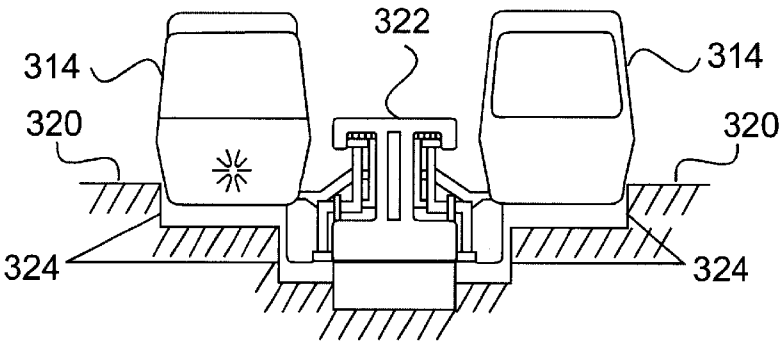
FIG. 18*a* is a cross-section along the line 18*a*—18*a* in FIG. 18.

In FIGS. 18*a*, 18*b*, dual-sided monorail vehicles (314) are shown in an at-grade location available for passenger access. The elevated guideways (316) are shown connected with sloping guideways (318) to at-grade boarding location (320) where passengers can access vehicles at guideway (322) without need for stairs or elevators. Sloping guideways may use smooth steel rails, grit-rails, or geared rails for positive traction during descent and climb, according to the need of the individual station and angle of the sloping guideways. Safety pits (324) are shown to allow for safety in the event a person is in the path of the vehicles while at grade. Access of passengers to the opposite side of the guideway (322) is by passing beneath the sloping guideways (318).

The at-grade station offers transit system construction at lower total cost, and makes possible more transit service available at lower construction and operating costs.

22. Means For Speed and Acceleration Control

Figure 19A:
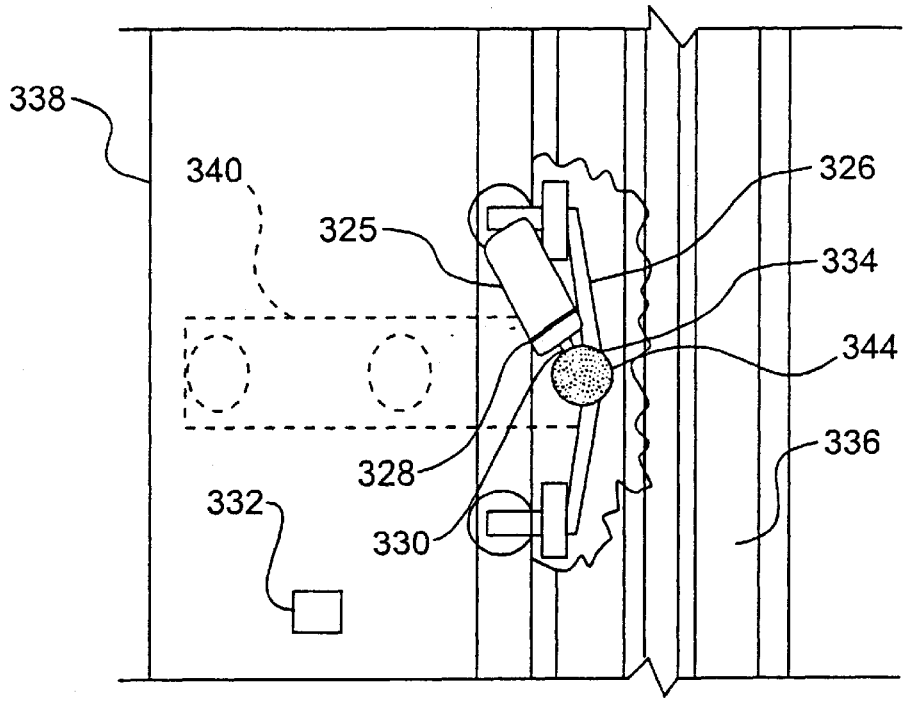
FIGS. 19*a* and 19*b* are a top view and end view of a mechanism for speed and acceleration control according to an aspect of the present invention.
Figure 19B:
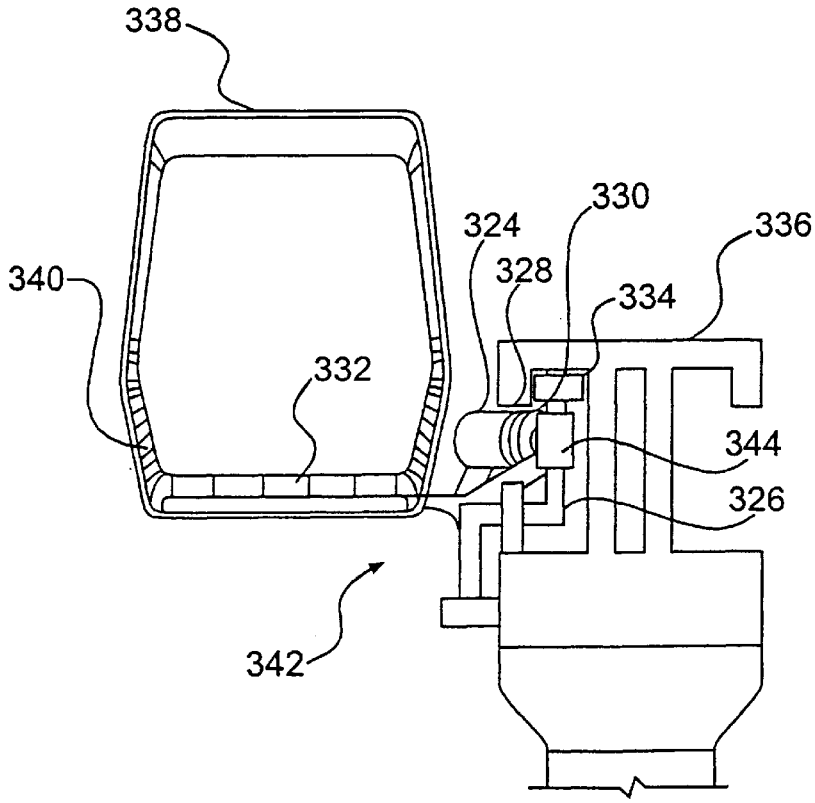
Figure 20A:
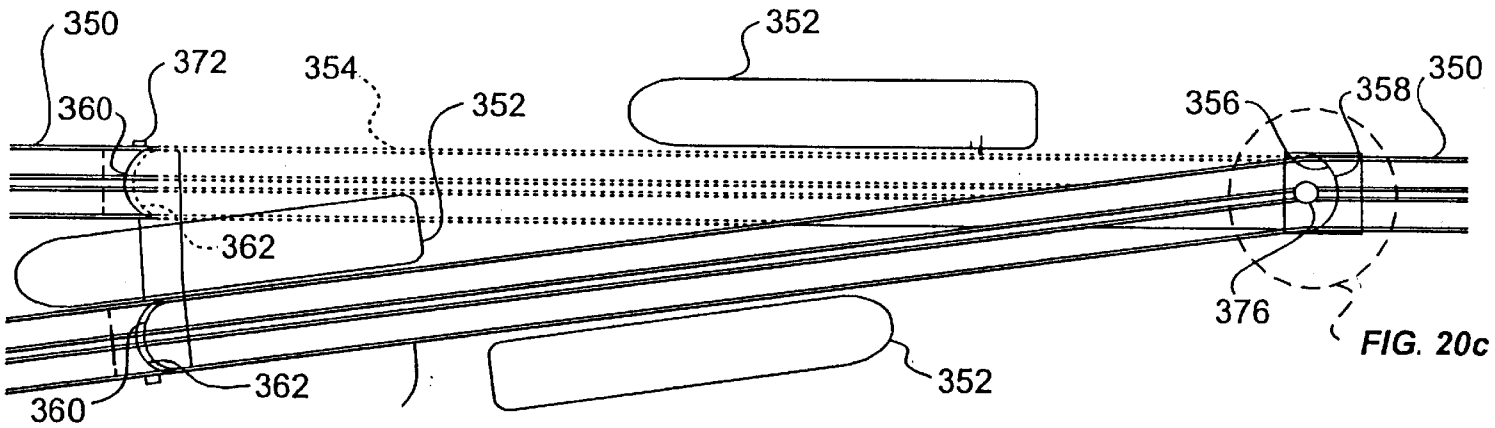
FIG. 20*a* is a top view of a mechanism for switching a transit vehicle on a guideway according to an aspect of the present invention.
Figure 20B:
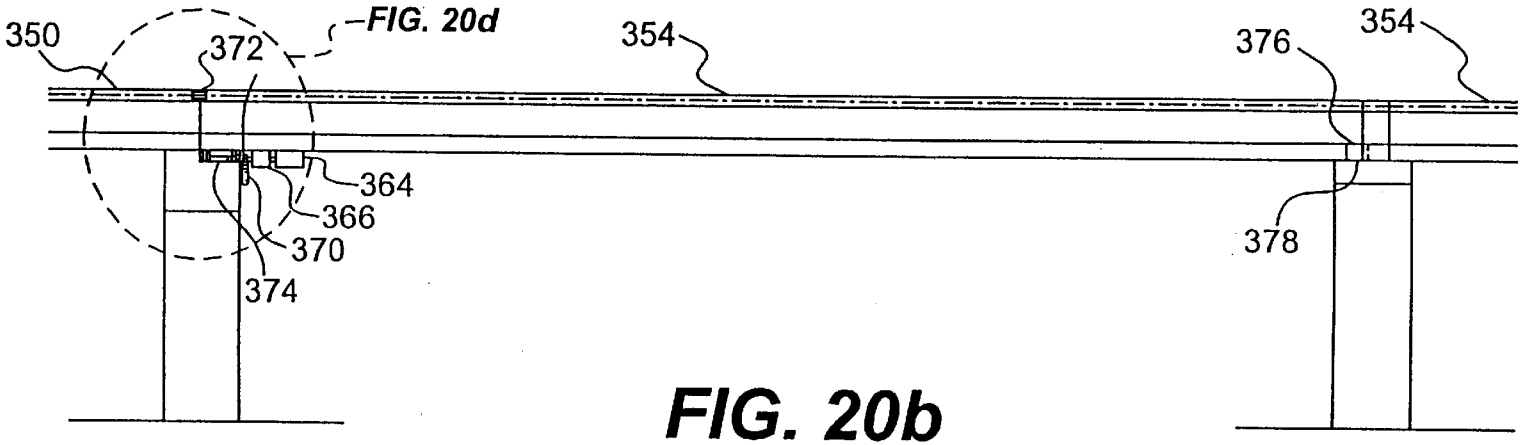
FIG. 20*b* is a side elevation of the mechanism for switching.
Figure 20C:
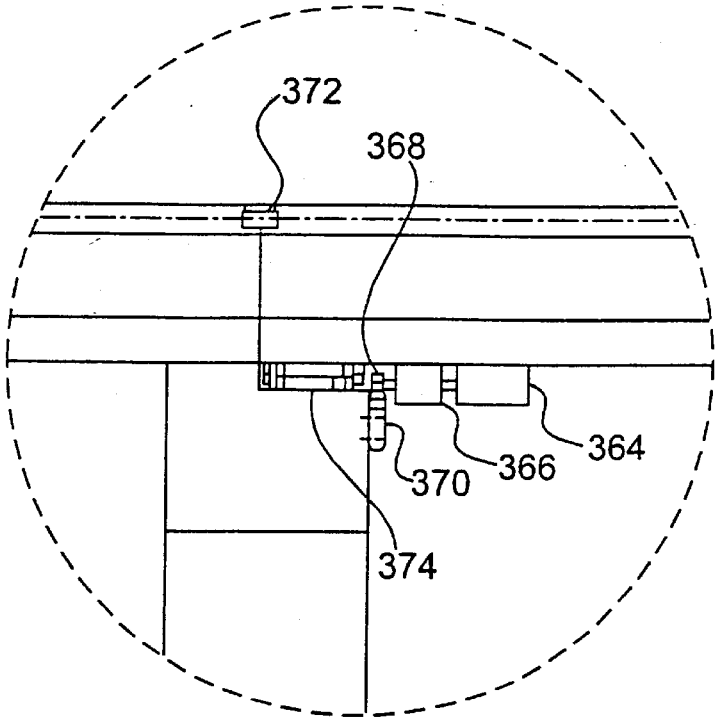
FIG. 20*c* is an enlarged view of the portion of FIG. 20*a* inside circle 20*c;*
Figure 20D:
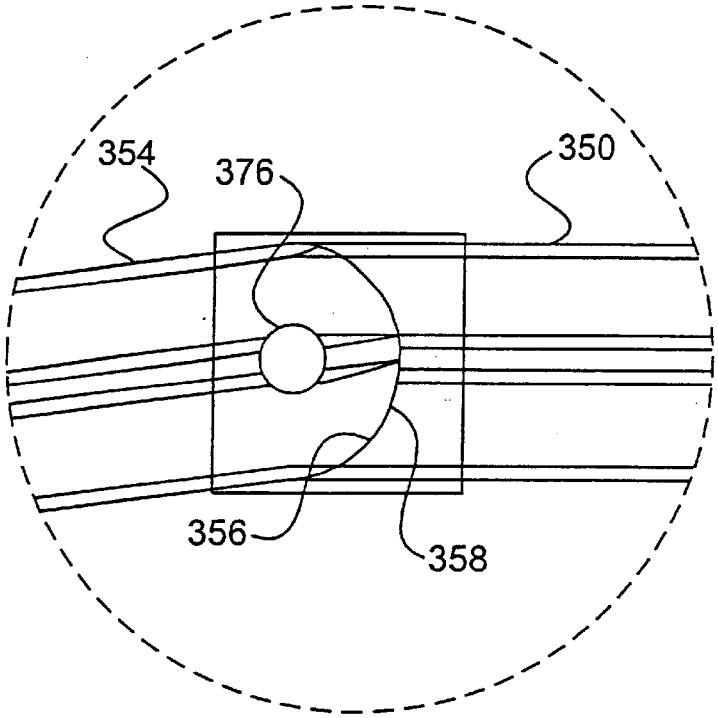
FIG. 20*d* is an enlarged view of the portion of FIG. 20*b* inside circle 20*d;*

A motor and clutch arrangement that is different from that shown in FIG. 21 is shown in FIGS. 19*a*, 19*b*. In FIGS. 19*a*, 19*b*, an electric motor (325) having a variable-output torque magnetic flux clutch device internal to it or separately attached to it on a common frame (326) provides torque through a rotating shaft to an electric magnetic flux clutch (328) which transfers a variable portion of such received torque to an output rotating shaft (330), in accordance with a control voltage or signal from a controller (332) which limits the clutch to provide a precise amount of torque or rpm (revolutions per minute) to a vehicle drive wheel (334) in accordance with a controls logic. The clutch (328) may be fully electromagnetic using only magnetic lines of flux (by preference), or may be a particle clutch in which magnetized particles are interposed to make a mechanical slipping connection between the driving shaft and the driven shaft. Further, the clutch (328) may employ liquids or gases in a housing containing driving and driven turbines with variable vanes, or may utilize gearing and shifting mechanisms as are commonly used in automatic transmissions of automobiles and drive units. All portions of the drive assembly except the guideway (336) move as part of vehicle (338). Only one wheel and drive (342) of vehicle (338) is shown. The drive assembly is connected to the vehicle by an arm (340).

Additionally, the output torque may be provided by the clutch (328) output shaft to an optional gearbox (344) for transmission of torque to a vehicle drive wheel (334) at a greater or lesser rpm and to allow a torque path to be turned 90 degrees. The motor and clutch arrangement for applying power to a wheel may remain co-linear with the clutch output shaft with or without the optional gearbox.

Although the preferred method is to allow the motor to run continuously and to modify the clutch output to the drive wheel and to use with it an external braking system, an alternate method is to run the motor only for vehicle driving force applied to the wheel through the electromagnetic clutch, and to stop the motor, drive wheel, and the output shaft with a similarly applied electromagnetic brake or mechanical brake applied to the drive shaft, thereby braking the vehicle. Such motor, clutch, gearbox, and drivewheel arrangement may be used singly or in multiples, with or without interlocking of controls of clutches and motors.

Representative motor-clutch arrangements that are suitable for the described application are those available from Magnatek and Stromag, Inc. (the Magnaspeed Drive).

This clutch arrangement allows computer control of shaft torque while the motor runs and cools continuously. It also allows smooth application of torque to the wheels providing controlled smooth acceleration of the vehicle for passenger comfort.

23. Mechanism for Switching Transit Vehicles on a Guideway.

In FIG. 20, a guideway (350) for dual-sided monorail vehicles (352) has a swinging beam switch (354) which is allowed to rotate at one end of a fixed guideway (350), with the end of the moving beam having a convex end surface (356) which matches closely a concave surface (358) on the end of the fixed guideway beam. Additionally, the opposite end of the moving beam switch has a convex surface (360), and the adjoining ends of the fixed guideways have matching concave surfaces (362). Rails and electrical power bars are similarly configured. Power is carried from the fixed guideway power bars by means of flexible cabling (not shown) to the power bars on the moving switch beam. Control wiring is similarly connected to the guideways. Pass-through of power and controls signals is by means (surface or subsurface) other than through the moving switch guideway beam. The arrangement shown is for displacement of the guideway switch beam to be sufficient to allow a moving vehicle to be switched while allowing only sufficient clearance from an adjacent fixed guideway end to avoid interference, in order to minimize the switch beam displacement angle, the distance for the moving element to be moved, and the time required for switch guideway beam displacement and return to its original position.

Motive power for the moving switch beam is by one or more electric motors (364) driving a gear box (366) and gear (368) which positively engages a gear rack (370) at the moving switch beam end. Control for the motors is by command of the switch action through the central control system. End switches (372) on the guideways provide indication of position of the moving beam and thereby control the positioning of the guideway beam switch when switch command sequencing is begun.

The moving end of the moving guideway switch beam is supported by roller, ball, or bridge bearings (374) which allow free motion between guideway positions. The fixed end of the moving guideway switch beam is supported by a pin (376) and roller, ball or bridge bearings (378) which allow for sliding motion with low friction. Additional drives and supports for the moving switch beam may be provided as needed to account for various lengths and weights of the moving elements.

Material for the moving switch beam is shown as a concrete beam, but may be made of steel or other structural material suitable for the purpose.

While the invention has been described in connection with what is presently considered to be the most practical and preferred embodiments, it is to be understood that the invention is not to be limited to the disclosed embodiments, but, on the contrary, is intended to cover various modifications and equivalent arrangements included within the spirit and scope of the appended claims.

Furthermore, it should be noted that those of the appended claims which do not include language in the 'means for performing a specified function' format permitted under 35 U.S.C. §112(¶6), are intended to not be interpreted under 35 U.S.C. §112(¶6) as being limited to the structure, material, or acts described in the present specification and their equivalents.

What is claimed is:

1. A monorail transit system, comprising:

a beam adapted to be supported on a ground-supported foundation, said beam having two opposite sides;

a transit car body constructed and arranged to be supported with respect to said beam;

at least one transit car drive unit associated with said transit car body and in operative engagement with one of said two opposite sides of said beam, said at least one transit car drive unit comprising:

a frame;

a vertical support wheel assembly carried by said frame and including at least one wheel mounted for rotation and disposed in rolling engagement with a portion of said one side of said beam, said vertical support wheel assembly being constructed and arranged to provide vertical support;

a lateral support wheel assembly carried by said frame and including wheels mounted for rotation and disposed in rolling engagement with a different portion of said one side of said rail, said lateral support wheel assembly being constructed and arranged to provide lateral support;

a lateral frame extension extending away from said beam and constructed and arranged to couple said transit car body to said frame of said drive unit to thereby vertically and laterally support said transit car body via said vertical support wheel assembly and said lateral support wheel assembly; and a motor carried by said frame and constructed and arranged to drive the wheels of one of said vertical support wheel assembly and said lateral support wheel assembly to propel said transit car drive unit and said transit car body along said beam, wherein said lateral frame extension of each said transit car drive unit comprises:

a cantilevered support arm extending from said frame and disposed beneath said transit car body and providing a vertical supporting force to the transit car body;

transit car body connecting structure coupled to said support arm and an underside of said transit car body and constructed and arranged to connect said transit car body to said support arm;

thrust force transmission structures disposed between said support arm and said transit car body connecting structure and constructed and arranged to transmit propelling thrust generated by said drive unit from said support arm to said transit car body connecting structure and thereby to said transit car body; and brake force transmission structure disposed between said support arm and said transit car body connecting structure and constructed and arranged to transmit braking forces generated by said drive unit from said support arm to said transit car body connecting structure and thereby to said transit car body, said support arm being constructed and arranged to permit said transit car body connecting structure to move with respect thereto and said thrust force transmission structures and said brake force transmission structure being constructed and arranged to accommodate movement of said transit car body connecting structure with respect to said support arm to thereby permit said support arm to pivot with respect to said transit car body while said transit car body traverses a curved portion of said beam.

2. The monorail transit system according to claim 1, wherein said transit car body defines a passenger compartment, said passenger compartment including rows of passenger seats along one side of said compartment with overhead baggage-retaining structures disposed above said seats, floor-mounted baggage compartments along an opposite side of said compartment, and toilet facilities at one end of said compartment.

3. The monorail transit system according to claim 1, wherein said transit car body comprises a freight container, releasably secured to said lateral frame extension.

4. The monorail transit system according to claim 1, further including a braking system carried by said frame of said transit car drive unit, said braking system comprising:

a housing;

a friction pad;

a brake shoe movably disposed within said housing and having said friction pad secured thereto;

a base plate fixedly mounted within said housing in spaced relationship with respect to said brake shoe;

a biasing mechanism disposed between said base plate and said brake shoe and constructed and arranged to urge said brake shoe away from said base plate to thereby urge said friction pad into frictional, braking engagement with a portion of the one side of said beam; and a brake retracting mechanism disposed within said housing and operatively coupled with said brake shoe, said brake retracting mechanism being constructed and arranged to selectively move said friction pad against a biasing force of said biasing mechanism to variably disengage said friction pad assembly from the rail to provide a variable braking force.

5. A monorail transit system, comprising:

a beam adapted to be supported on a ground-supported foundation, said beam having two opposite sides;

a transit car body constructed and arranged to be supported with respect to said beam;

at least one transit car drive unit associated with said transit car body and in operative engagement with one of said two opposite sides of said beam, said at least one transit car drive unit comprising:

a frame;

a vertical support wheel assembly carried by said frame and including at least one wheel mounted for rotation and disposed in rolling engagement with a portion of said one side of said beam, said vertical support wheel assembly being constructed and arranged to provide vertical support;

a lateral support wheel assembly carried by said frame and including wheels mounted for rotation and disposed in rolling engagement with a different portion of said one side of said rail, said lateral support wheel assembly being constructed and arranged to provide lateral support;

a lateral frame extension extending away from said beam and constructed and arranged to couple said transit car body to said frame of said drive unit to thereby vertically and laterally support said transit car body via said vertical support wheel assembly and said lateral support wheel assembly; and a motor carried by said frame and constructed and arranged to drive the wheels of one of said vertical support wheel assembly and said lateral support wheel assembly to propel said transit car drive unit and said transit car body along said beam, wherein said lateral frame extension of each said transit car drive unit comprises:

a support arm extending from said frame and disposed beneath said transit car body;

transit car body connecting structure coudled to said support arm and an underside of said transit car body and constructed and arranged to connect said transit car body to said support arm;

thrust force transmission structures disposed between said support arm and said transit car body connecting structure and constructed and arranged to transmit propelling thrust generated by said drive unit from said support arm to said transit car body connecting structure and thereby to said transit car body; and brake force transmission structure disposed between said support arm and said transit car body connecting structure and constructed and arranged to transmit braking forces generated by said drive unit from said support arm to said transit car body connecting structure and thereby to said transit car body, said support arm being constructed and arranged to permit said transit car body connecting structure to move with respect thereto and said thrust force transmission structures and said brake force transmission structure being constructed and arranged to accommodate movement of said transit car body connecting structure with respect to support arm to thereby permit said support arm to pivot with respect to said transit car body while said transit car body traverses a curved portion of said beam, wherein said ground-supported foundation comprises a plurality of columns secured in the ground and extending upwardly therefrom, each of said columns including a head near an upper end thereof for supporting a portion of said beam thereon, said beam including a downwardly facing hollow portion formed along a longitudinal extent of said beam in the vicinity of each portion thereof supported by a respective one of said plurality of columns, said downwardly facing hollow portions having lateral side surfaces, each of said plurality of columns further including an insert extending upwardly from said head, said insert being received within said downwardly-facing hollow portion formed in the vicinity of said beam supported by said column with said lateral sides of said hollow portion being in close proximity to lateral side surfaces of said insert, said hollow portion and said insert being constructed and arranged to prevent said beam from moving laterally with respect to said column while permitting longitudinal movement of said beam with respect to said column.

6. A monorail transit system comprising:

a beam adapted to be supported on a ground-supported foundation said beam having two opposite sides;

a transit car body constructed and arranged to be supported with respect to said beam;

at least one transit car drive unit associated with said transit car body and in operative engagement with one of said two opposite sides of said beam, said at least one transit car drive unit comprising:

a frame;

a vertical support wheel assembly carried by said frame and including at least one wheel mounted for rotation and disposed in rolling engagement with a portion of said one side of said beam, said vertical support wheel assembly being constructed and arranged to provide vertical support;

a lateral support wheel assembly carried by said frame and including wheels mounted for rotation and disposed in rolling engagement with a different portion of said one side of said rail, said lateral support wheel assembly being constructed and arranged to provide lateral support;

a lateral frame extension extending away from said beam and constructed and arranged to couple said transit car body to said frame of said drive unit to thereby vertically and laterally support said transit car body via said vertical support wheel assembly and said lateral support wheel assembly; and a motor carried by said frame and constructed and arranged to drive the wheels of one of said vertical support wheel assembly and said lateral support wheel assembly to propel said transit car drive unit and said transit car body alone said beam, wherein said lateral frame extension of each said transit car drive unit comprises:

a support arm extending from said frame and disposed beneath said transit car body;

transit car body connecting structure coupled to said support arm and an underside of said transit car body and constructed and arranged to connect said transit car body to said support arm;

thrust force transmission structures disposed between said support arm and said transit car body connecting structure and constructed and arranged to transmit propelling thrust generated by said drive unit from said support arm to said transit car body connecting structure and thereby to said transit car body; and brake force transmission structure disposed between said support arm and said transit car body connecting structure and constructed and arranged to transmit braking forces generated by said drive unit from said support arm to said transit car body connecting structure and thereby to said transit car body, said support arm being constructed and arranged to permit said transit car body connecting structure to move with respect thereto and said thrust force transmission structures and said brake force transmission structure being constructed and arranged to accommodate movement of said transit car body connecting structure with respect to support arm to thereby permit said support arm to pivot with respect to said transit car body while said transit car body traverses a curved portion of said beam, comprising two of said transit car drive units associated with said transit car body, said system further comprising a pair of cables each fixed at opposite ends thereof to the respective support arms of a different one of said two drive units and passing around tension balance idler wheels, said cables being constructed and arranged to provide for coordinated motion of said two transit car drive units so that the transit car body is equally supported by the drive units.

7. A monorail transit system, comprising:

a beam adapted to be supported on a ground-supported foundation, said beam having two opposite sides;

a transit car body constructed and arranged to be supported with respect to said beam;

at least one transit car drive unit associated with said transit car body and in operative engagement with one of said two opposite sides of said beam, said at least one transit car drive unit comprising:

a frame;

a vertical support wheel assembly carried by said frame and including at least one wheel mounted for rotation and disposed in rolling engagement with a portion of said one side of said beam, said vertical support wheel assembly being constructed and arranged to provide vertical support;

a lateral support wheel assembly carried by said frame and including wheels mounted for rotation and disposed in rolling engagement with a different portion of said one side of said rail, said lateral support wheel assembly being constructed and arranged to provide lateral support;

a lateral frame extension extending away from said beam and constructed and arranged to couple said transit car body to said frame of said drive unit to thereby vertically and laterally support said transit car body via said vertical support wheel assembly and said lateral support wheel assembly; and a motor carried by said frame and constructed and arranged to drive the wheels of one of said vertical support wheel assembly and said lateral support wheel assembly to propel said transit car drive unit and said transit car body along said beam, wherein said lateral frame extension of each said transit car drive unit comprises:

a support arm extending from said frame and disposed beneath said transit car body;

transit car body connecting structure coupled to said support arm and an underside of said transit car body and constructed and arranged to connect said transit car body to said support arm;

thrust force transmission structures disposed between said support arm and said transit car body connecting structure and constructed and arranged to transmit propelling thrust generated by said drive unit from said support arm to said transit car body connecting structure and thereby to said transit car body; and brake force transmission structure disposed between said support arm and said transit car body connecting structure and constructed and arranged to transmit braking forces generated by said drive unit from said support arm to said transit car body connecting structure and thereby to said transit car body, said support arm being constructed and arranged to permit said transit car body connecting structure to move with respect thereto and said thrust force transmission structures and said brake force transmission structure being constructed and arranged to accommodate movement of said transit car body connecting structure with respect to support arm to thereby permit said support arm to pivot with respect to said transit car body while said transit car body traverses a curved portion of said beam, wherein said transit car body includes leveling mechanisms attached on an exterior portion thereof and constructed and arranged to engage cooperating leveling mechanisms of an adjacent loading platform to position said transit car body in a preferred orientation with respect to the loading platform.

8. A monorail transit system, comprising:

a beam adapted to be supported on a ground-supported foundation, said beam having two opposite sides;

a transit car body constructed and arranged to be supported with respect to said beam;

at least one transit car drive unit associated with said transit car body and in operative engagement with one of said two opposite sides of said beam, said at least one transit car drive unit comprising:

a frame;

a vertical support wheel assembly carried by said frame and including at least one wheel mounted for rotation and disposed in rolling engagement with a portion of said one side of said beam, said vertical support wheel assembly being constructed and arranged to provide vertical support;

a lateral support wheel assembly carried by said frame and including wheels mounted for rotation and disposed in rolling engagement with a different portion of said one side of said rail, said lateral support wheel assembly being constructed and arranged to provide lateral support;

a lateral frame extension extending away from said beam and constructed and arranged to couple said transit car body to said frame of said drive unit to thereby vertically and laterally support said transit car body via said vertical support wheel assembly and said lateral support wheel assembly; and a motor carried by said frame and constructed and arranged to drive the wheels of one of said vertical support wheel assembly and said lateral support wheel assembly to propel said transit car drive unit and said transit car body along said beam, wherein said lateral frame extension of each said transit car drive unit comprises:

a support arm extending from said frame and disposed beneath said transit car body;

transit car body connecting structure coupled to said support arm and an underside of said transit car body and constructed and arranged to connect said transit car body to said support arm;

thrust force transmission structures disposed between said support arm and said transit car body connecting structure and constructed and arranged to transmit propelling thrust generated by said drive unit from said support arm to said transit car body connecting structure and thereby to said transit car body; and brake force transmission structure disposed between said support arm and said transit car body connecting structure and constructed and arranged to transmit braking forces generated by said drive unit from said support arm to said transit car body connecting structure and thereby to said transit car body, said support arm being constructed and arranged to permit said transit car body connecting structure to move with respect thereto and said thrust force transmission structures and said brake force transmission structure being constructed and arranged to accommodate movement of said transit car body connecting structure with respect to support arm to thereby permit said support arm to pivot with respect to said transit car body while said transit car body traverses a curved portion of said beam; and a car body tilting and leveling mechanism, including:

a first side elevation adjusting mechanism constructed and arranged to vary the elevation of a first side of said transit car body;

a second side elevation adjusting mechanism constructed and arranged to vary the elevation of a second side of said transit car body, said second side of said transit car body being opposite said first side;

a centrifugal force detecting mechanism constructed and arranged to detect the magnitude of centrifugal forces acting on said transit car body; and a controller constructed and arranged to receive signals from said centrifugal force detecting mechanism and to selectively activate one of said first side elevation adjusting mechanism and said second side elevation adjusting mechanism in response to the signals from the centrifugal force detecting mechanism to raise the elevation of one of said first and second sides of said transit car body to tilt said transit car body laterally to compensate for the centrifugal forces and to activate the one of said first side elevation adjusting mechanism and said second side elevation adjusting mechanism in response to the signals from the centrifugal force detecting mechanism to lower the one of said first and second sides of said transit car body so that said transit car body is again approximately level when said transit car body is no longer subjected to the centrifugal forces.

9. The monorail transit system according to claim 1, further comprising a car body tilting and leveling mechanism, including:

a first side elevation adjusting mechanism constructed and arranged to vary the elevation of a first side of said transit car body;

a second side elevation adjusting mechanism constructed and arranged to vary the elevation of a second side of said transit car body, said second side of said transit car body being opposite said first side;

a centrifugal force detecting mechanism constructed and arranged to detect the magnitude of centrifugal forces acting on said transit car body; and a controller constructed and arranged to receive signals from said centrifugal force detecting mechanism and to selectively activate one of said first side elevation adjusting mechanism and said second side elevation adjusting mechanism in response to the signals from the centrifugal force detecting mechanism to raise the elevation of one of said first and second sides of said transit car body to tilt said transit car body laterally to compensate for the centrifugal forces and to activate the one of said first side elevation adjusting mechanism and said second side elevation adjusting mechanism in response to the signals from the centrifugal force detecting mechanism to lower the one of said first and second sides of said transit car body so that said transit car body is again approximately level when said transit car body is no longer subjected to the centrifugal forces.

10. The monorail transit system according to claim 1, wherein said transit car body is articulated and includes a forward portion and a rear portion constructed and arranged to pivot independently of each other with respect to said beam and including a flexible wall structure flexibly connecting walls of said forward portion with walls of said rear portion.

11. A ground-supported foundation for an elevated transit system including a transit vehicle which travels along an elevated track, said ground-supported foundation comprising:

a beam supporting the track along which the transit vehicle travels; and a plurality of columns secured in the ground and extending upwardly therefrom, each of said columns including a head near an upper end thereof for supporting a portion of said beam in an elevated position thereon, said beam including a downwardly facing hollow portion formed along a longitudinal extent of said beam in the vicinity of each portion thereof supported by a respective one of said plurality of columns, said downwardly facing hollow portions having lateral side surfaces, each of said plurality of columns further including an insert extending upwardly from said head, said insert being received within said downwardly-facing hollow portion formed in the vicinity of said beam supported by said column with said lateral sides of said hollow portion being in close proximity to lateral side surfaces of said insert, said hollow portion and said insert being constructed and arranged to prevent said beam from moving laterally with respect to said column while permitting longitudinal movement of said beam with respect to said column.

12. A rail assembly for a transit vehicle which travels along a track defined by said rail assembly, said rail assembly comprising:

a foundation structure presenting an upwardly-facing surface;

a steel rail supported on said upwardly facing surface and secured to said foundation structure by anchoring devices; and a resilient vibration pad disposed between said steel rail and said upwardly-facing surface, said resilient vibration pad being pre-stressed in compression by said steel rail secured to said foundation structure by said anchoring devices.

13. A braking system for a transit vehicle which travels on a track defined by at least one rail, said braking system comprising:

a housing carried by the transit vehicle in opposed relation to the rail;

a base plate fixedly mounted within said housing;

a friction pad assembly movably disposed within said housing between said base plate and the rail;

a biasing mechanism disposed between said base plate and said friction pad assembly and constructed and arranged to generate a biasing force that urges said friction pad assembly away from said base plate to thereby urge said friction pad assembly into frictional, braking engagement with the rail; and a brake retracting mechanism disposed within said housing and operatively coupled with said friction pad assembly, said brake retracting mechanism being constructed and arranged to selectively move said friction pad assembly against the biasing force of said biasing mechanism to variably disengage said friction pad assembly from the rail to provide a variable braking force.

14. In a transit system including multiple transit vehicles traveling along a common track and stopping at loading stations along the track to unload contents of the transit vehicles and to load new contents into the transit vehicles, a method for extending the effective dwell time of each of the transit vehicles at a loading station, said method comprising:

stopping each transit vehicle arriving at the loading station at an unloading position within the loading station and unloading contents of the vehicle while the vehicle is stopped at the unloading position; and moving the transit vehicle forward along the track and stopping the transit vehicle at one or more loading positions within the loading station spaced from the unloading position and loading new contents into the vehicle while the vehicle is stopped at the one or more loading positions, thereby permitting a subsequent transit vehicle traveling along the track and arriving at the loading station to stop at the unloading position while contents of the subsequent vehicle are unloaded and while new contents are being loaded into the vehicle stopped at the one or more loading positions.

* * * * *